US011179943B2

(12) United States Patent
Otashiro et al.

(10) Patent No.: US 11,179,943 B2
(45) Date of Patent: Nov. 23, 2021

(54) LIQUID CONTAINER, MOUNTING BODY, AND LIQUID EJECTING APPARATUS

(71) Applicant: SEIKO EPSON CORPORATION, Tokyo (JP)

(72) Inventors: Mao Otashiro, Shiojiri (JP); Takumi Nagashima, Matsumoto (JP); Tomoyuki Miyazawa, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/885,475

(22) Filed: May 28, 2020

(65) Prior Publication Data

US 2020/0376848 A1 Dec. 3, 2020

(30) Foreign Application Priority Data

May 29, 2019 (JP) ..... JP2019-099857

(51) Int. Cl.
*B41J 2/175* (2006.01)

(52) U.S. Cl.
CPC ..... *B41J 2/17526* (2013.01); *B41J 2/17523* (2013.01)

(58) Field of Classification Search
CPC ..... B41J 2/17526; B41J 2/17523; B41J 2/17509; B41J 2002/17516; B41J 2/17553; B41J 2/17513; B41J 2/1753; B41J 2/1752; B41J 2/01
USPC ..... 347/86
See application file for complete search history.

(56) References Cited

U.S. PATENT DOCUMENTS

| | | | | |
|---|---|---|---|---|
| 2008/0252701 | A1* | 10/2008 | Matsumoto | B41J 2/17553 347/86 |
| 2016/0221349 | A1* | 8/2016 | Aoki | B41J 2/17553 |
| 2018/0043694 | A1* | 2/2018 | Toya | B41J 2/17553 |
| 2018/0043695 | A1 | 2/2018 | Kawate et al. | |
| 2019/0263159 | A1 | 8/2019 | Shimomura et al. | |
| 2020/0171864 | A1 | 6/2020 | Shimomura | |

FOREIGN PATENT DOCUMENTS

| | | | |
|---|---|---|---|
| EP | 3466694 | A1 | 4/2019 |
| JP | 2018-024195 | A | 2/2018 |
| JP | 2019-151094 | A | 9/2019 |
| JP | 2020-082595 | A | 6/2020 |
| WO | 2018/030330 | A1 | 2/2018 |

* cited by examiner

*Primary Examiner* — Huan H Tran
*Assistant Examiner* — Alexander D Shenderov
(74) *Attorney, Agent, or Firm* — Oliff PLC

(57) ABSTRACT

A liquid container includes a liquid containing portion containing a liquid, a liquid supply port through which the liquid of the liquid containing portion flows out, a container-side electrical coupling portion that is disposed on the −X direction side of the liquid supply port, a first receiving portion that is disposed on the −X direction side of the liquid supply port, and that is configured to receive insertion of a first positioning portion provided in the liquid ejecting apparatus, a second receiving portion that is disposed on the +X direction side of the liquid supply port, and that is configured to receive insertion of a second positioning portion provided in the liquid ejecting apparatus, and a third receiving portion configured to receive insertion of a third positioning portion provided in the liquid ejecting apparatus, on the +Y direction side of the liquid containing portion.

8 Claims, 20 Drawing Sheets

LIQUID CONTAINER, MOUNTING BODY, AND LIQUID EJECTING APPARATUS

The present application is based on, and claims priority from JP Application Serial Number 2019-099857, filed May 29, 2019, the disclosure of which is hereby incorporated by reference herein in its ultimately.

BACKGROUND

1. Technical Field

The present disclosure relates to a liquid container.

2. Related Art

As an aspect of a liquid container, for example, there is a so-called ink pack in which ink supplied to an ink jet printer which is an aspect of a liquid ejecting apparatus is contained in a flexible bag-like member. International Publication WO2018/030330A1 and JP-A-2018-24195 below disclose an ink pack which is mounted on a printer in a state where the ink pack is disposed in a case and establishes an ink supply path to the printer and an electrical communication path.

It is desirable that the ink pack may be configured to be mounted in a more appropriate posture with respect to the printer so that a stable and good coupling state with the printer can be established and the coupling state can be maintained. These problems are not limited to the ink pack mounted on the printer, and are common to the liquid container mounted on the liquid ejecting apparatus.

SUMMARY

An aspect of a technique of the present disclosure is provided as a liquid container be attachable to and detachable from a liquid ejecting apparatus. When three directions orthogonal to each other in the liquid container are defined as an X direction, a Y direction, and a Z direction, a moving direction of the liquid container when mounting the liquid container on the liquid ejecting apparatus is defined as a +Y direction and a moving direction of the liquid container when removing the liquid container from the liquid ejecting apparatus is defined as a −Y direction in the Y direction, and a positive direction is defined as a +X direction and a negative direction is defined as a −X direction in the X direction, the liquid container according to this aspect includes a liquid containing portion in which a liquid supplied to the liquid ejecting apparatus is contained, a liquid supply port that is disposed on the +Y direction side of the liquid containing portion, that is coupled to the liquid ejecting apparatus, and through which the liquid of the liquid containing portion flows out, a container-side electrical coupling portion that is disposed on the +Y direction side of the liquid containing portion and on the −X direction side of the liquid supply port, and that is electrically coupled to the liquid ejecting apparatus, a first receiving portion that is disposed on the +Y direction side of the liquid containing portion and on the −X direction side of the liquid supply port, that is provided at a position different from that of the container-side electrical coupling portion in the Z direction, and that is configured to receive insertion of a first positioning portion provided in the liquid ejecting apparatus in the −Y direction, a second receiving portion that is disposed on the +Y direction side of the liquid containing portion and on the +X direction side of the liquid supply port, and that is configured to receive insertion of a second positioning portion provided in the liquid ejecting apparatus in the −Y direction, and a third receiving portion that is disposed on the +Y direction side of the liquid containing portion and on the +X direction side of the liquid supply port, that is provided at a position different from that of the second receiving portion in the Z direction, and that is configured to receive insertion of a third positioning portion provided in the liquid ejecting apparatus in the −Y direction.

DESCRIPTION OF EXEMPLARY EMBODIMENTS

1. First Embodiment

1-1. Configuration of Liquid Ejecting Apparatus

Figure 1:
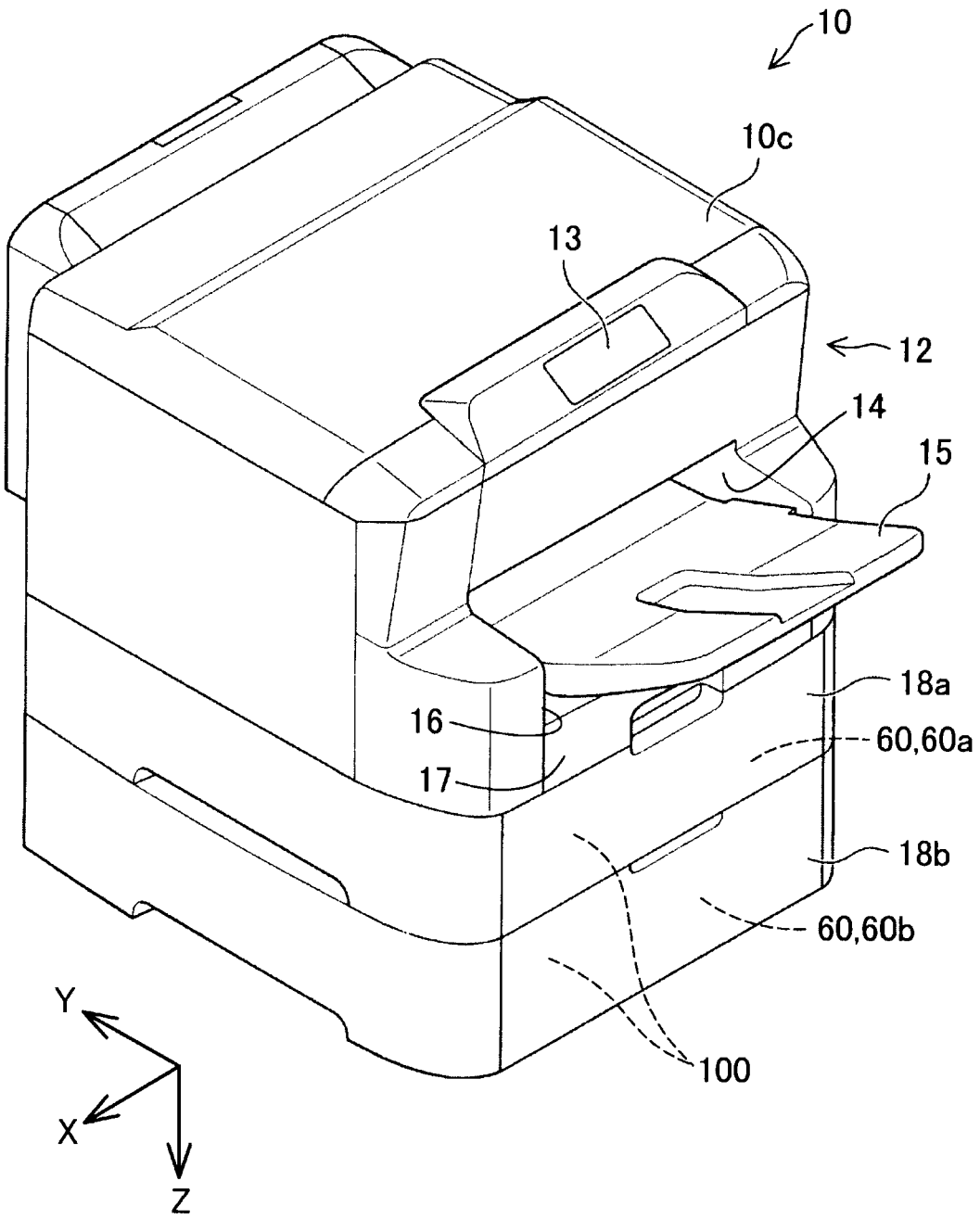
FIG. 1 is a schematic perspective view illustrating an appearance configuration of a liquid ejecting apparatus.

FIG. 1 is a schematic perspective view illustrating an appearance configuration of a liquid ejecting apparatus 10 to which a liquid container 100 of the present embodiment is mounted. Hereinafter, the description will be made based on a posture of the liquid ejecting apparatus 10 in a normal use state unless otherwise specified. The normal use state of the liquid ejecting apparatus 10 is a state where the liquid ejecting apparatus 10 is disposed on a horizontal plane. In the following description, a vertical direction is a direction parallel to a direction of gravity, and a lateral direction and a front and rear direction are directions parallel to a horizontal direction orthogonal to each other. FIG. 1 illustrates an X direction, a Y direction, and a Z direction indicating the direction of the liquid container 100 when is in a mounting posture mounted on the liquid ejecting apparatus 10. In FIG. 1, since the liquid container 100 is accommodated inside the liquid ejecting apparatus 10 and cannot be seen, the position where the liquid container 100 is accommodated is indicated by a broken line. The X, Y, and Z directions of the liquid container 100 will be described later. The Y direction corresponds to a front and rear direction of the liquid ejecting apparatus 10, the X direction corresponds to a width direction of the liquid ejecting apparatus 10, and the Z direction corresponds to a vertical direction, that is, a height direction of the liquid ejecting apparatus 10. Arrows indicating the X direction, the Y direction, and the Z direction are also illustrated in FIGS. 2 to 5 referred to later so as to correspond to FIG. 1.

In the present embodiment, the liquid ejecting apparatus 10 is an ink jet printer, and performs printing by ejecting ink which is a liquid supplied from the liquid container 100 which is attachably and detachably mounted inside the apparatus. The liquid ejecting apparatus 10 forms an image by ejecting ink droplets and recording ink dots on a medium to be processed. In the present embodiment, the ink is, for example, a pigment ink, and the medium is, for example, a printing sheet. However, the ink is not limited to the pigment ink, and various inks such as a dye ink can be used. The same applies to the medium, and various media such as cloth and plate-like members can be used without being limited to the printing sheet.

The liquid ejecting apparatus 10 according to the present embodiment is provided with a housing 10*c* which is a resin hollow box constituting an exterior of the liquid ejecting apparatus 10. The housing 10*c* has a substantially rectangular parallelepiped shape. The front surface portion 12, which is assumed to face the user when operating the liquid ejecting apparatus 10, is provided with an operation portion 13, a medium discharge port 14, a medium receiving portion 15, a medium accommodation port 16, a medium accommodation portion 17 and two cover members 18*a* and 18*b*.

The operation portion 13 includes a display portion that displays information for the user, and a plurality of operation buttons that accept user operations. The medium discharge port 14 is an outlet of the medium fed from the inside of the liquid ejecting apparatus 10. The medium discharge port 14 is formed as a substantially rectangular opening portion that is wide in the lateral direction. The medium receiving portion 15 protrudes forward like an eave below the medium discharge port 14 and receives the medium discharged from the medium discharge port 14.

The medium accommodation port 16 is an opening portion for a user to supply the medium to the liquid ejecting apparatus 10. In the present embodiment, the medium accommodation port 16 is opened below the medium receiving portion 15 and has a substantially rectangular opening shape that is wide in the lateral direction. The medium accommodation portion 17 is a tray-like member that accommodates a stock of the medium that is a processing target medium in the present embodiment. The medium accommodation portion 17 is accommodated in the medium accommodation port 16 with the front surface visible from outside the liquid ejecting apparatus 10 through the medium accommodation port 16. The user can supply the medium to the liquid ejecting apparatus 10 by accommodating the medium in the medium accommodation portion 17 drawn out from the medium accommodation port 16 and loading the medium accommodation portion 17 in the medium accommodation port 16.

The cover members 18*a* and 18*b* are plate-like members made of resin, which constitute a portion of the exterior of the liquid ejecting apparatus 10, and close a first accommodation portion 60*a* and a second accommodation portion 60*b* of the case accommodation portion 60 provided inside the liquid ejecting apparatus 10. The liquid container 100 is accommodated in each of the accommodation portions 60*a* and 60*b*. In the present embodiment, the cover members 18*a* and 18*b* have substantially rectangular shapes that are wide in the lateral direction, and are disposed vertically below the medium accommodation port 16. The cover members 18*a* and 18*b* have claw portions (not illustrated) on the outer peripheral edges, and are attachably and detachably attached to the housing 10*c*. The cover members 18*a* and 18*b* cover and protect a plurality of liquid containers 100 accommodated in the case accommodation portion of the liquid ejecting apparatus 10.

Figure 2:
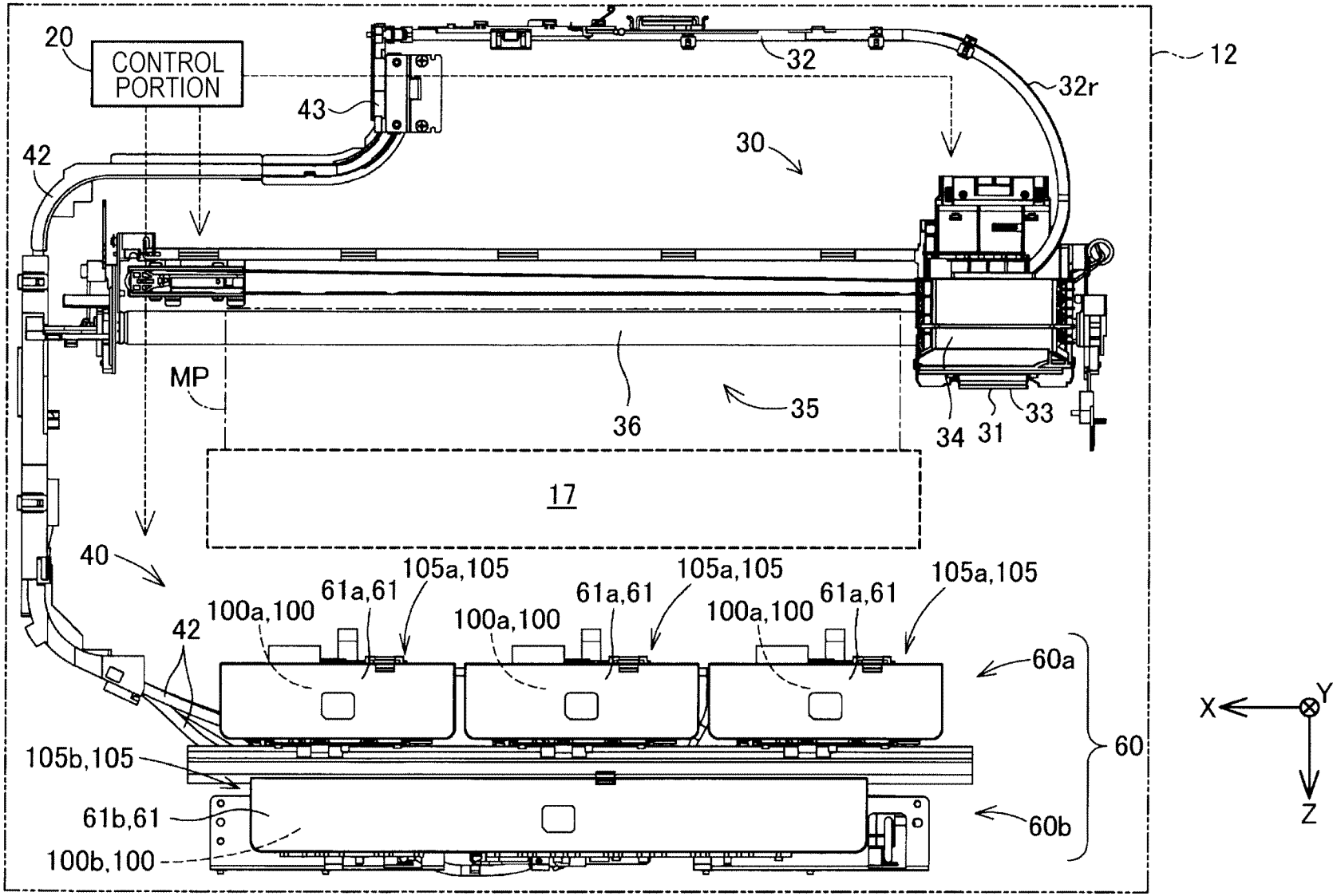
FIG. 2 is a schematic diagram illustrating an internal configuration of the liquid ejecting apparatus.

The outline of the internal configuration of the liquid ejecting apparatus 10 will be described with reference to FIGS. 2, 3A, 3B, 4, and 5. FIG. 2 is a schematic diagram when the liquid ejecting apparatus 10 is viewed from a front in plan view with the housing 10*c* and the cover members 18*a* and 18*b* removed. FIG. 2 illustrates a control portion 20, an ejection execution portion 30, a medium transport portion 35, and a liquid supply portion 40, which are extracted therefrom, of the components of the liquid ejecting apparatus 10. In addition, in FIG. 2, a disposition region of the medium accommodation portion 17 is illustrated by a broken line.

The liquid ejecting apparatus 10 is provided with the control portion 20, the ejection execution portion 30, the medium transport portion 35, and the liquid supply portion 40. In the liquid ejecting apparatus 10, the liquid is supplied from the liquid container 100 accommodated in the case accommodation portion 60 of the liquid supply portion 40 to the ejection execution portion 30 through a supply pipe 42. The ejection execution portion 30 forms a print image on a medium MP by discharging liquid onto the medium MP fed out and transported from the medium accommodation portion 17 by the medium transport portion 35. Hereinafter, the control portion 20, the ejection execution portion 30, the medium transport portion 35, and the liquid supply portion 40 will be described in order.

The control portion 20 controls driving of each component of the liquid ejecting apparatus 10. The control portion 20 is configured to include a microcomputer including at least a central processing unit and a main storage device, and performs various functions for controlling the liquid ejecting apparatus 10 by causing the central processing unit to read and execute various programs in the main storage device.

The ejection execution portion 30 is provided with a head portion 31 and a plurality of tubes 32. The head portion 31 receives a supply of liquid from the liquid supply portion 40 through the plurality of tubes 32. A mechanism of supplying the liquid from the liquid supply portion 40 will be described later. The head portion 31 is provided with a liquid chamber (not illustrated) that contains the liquid supplied from the liquid supply portion 40. A nozzle 33 that opens downward is provided on a bottom surface of the liquid chamber. The head portion 31 discharges the liquid in the liquid chamber from the nozzle 33 under a control of the control portion 20 by a known method such as applying pressure to the liquid by a piezo element, for example.

In the present embodiment, the head portion 31 is mounted on a carriage 34 and is configured to reciprocate linearly in the lateral direction under the control of the control portion 20. In the present embodiment, a main scanning direction of the liquid ejecting apparatus 10 is the lateral direction. Although a detailed description is omitted, the ejection execution portion 30 is provided with a guide shaft for moving the carriage 34, a motor for generating a driving force, and a pulley and a pulley belt for transmitting the driving force, as a driving mechanism for moving the head portion 31.

The plurality of tubes 32 coupled to the head portion 31 have flexibility. The plurality of tubes 32 are disposed in parallel in the front and rear direction. The plurality of tubes 32 are routed in a substantially straight line along a scanning path of the head portion 31 from a joint portion 43 which is a coupling portion with a supply pipe 42 of the liquid supply portion 40 described later, and are coupled to the head portion 31 by being curved downward. A curved portions 32*r* of the plurality of tubes 32 are displaced as the head portion 31 moves. As a result, the main scanning of the head portion 31 is prevented from being hindered by the plurality of tubes 32, and the moving operation of the head portion 31 is facilitated.

A medium transport portion 35 transports the medium MP to be processed under the control of the control portion 20. The medium transport portion 35 is provided with a transport roller 36 spanned in the lateral direction. The above-described medium accommodation portion 17 is disposed below the transport roller 36. The medium transport portion 35 is provided with a feeding mechanism (not illustrated) that feeds the media MP one by one from the medium accommodation portion 17 onto the outer peripheral side surface of the transport roller 36. The medium transport portion 35 rotates the transport roller 36 by a drive motor (not illustrated), and transports the medium MP forward below the head portion 31 by the rotational driving force. In the present embodiment, the sub-scanning direction of the liquid ejecting apparatus 10 is a direction from the rear to the front. The medium MP passed through the lower region of the head portion 31 is discharged outside the liquid ejecting apparatus 10 through the medium discharge port 14 illustrated in FIG. 1.

When printing processing is performed in the liquid ejecting apparatus 10, the control portion 20 causes the medium transport portion 35 to transport the medium MP in the sub-scanning direction described above. In addition, the control portion 20 reciprocates the head portion 31 in the main scanning direction along the transport roller 36 above the transport roller 36, and causes the head portion 31 to eject ink droplets toward the print surface of the medium MP at a timing determined based on the print data. As a result, ink dots are recorded on the medium MP at positions determined based on the print data, and an image based on the print data is formed.

The liquid supply portion 40 is provided with a case accommodation portion 60 in which a plurality of cases 61 are accommodated. The case 61 is used for mounting the liquid container 100 on the liquid ejecting apparatus 10. In the present embodiment, the case 61 is configured as a tray-like container. One liquid container 100 is attachably and detachably disposed for each of the cases 61. The liquid container 100 is mounted on the liquid ejecting apparatus 10 in a state where the liquid container 100 is disposed in the case 61. Hereinafter, the case 61 in which the liquid container 100 is disposed is also referred to as a "mounting body 105". In FIG. 2, since the liquid container 100 is hidden behind the case 61 and cannot be seen, a disposition position of the liquid container 100 is denoted by a broken line.

In the liquid ejecting apparatus 10 according to the present embodiment, the case accommodation portion 60 is provided at the lowermost stage. In addition, in the present embodiment, the case accommodation portion 60 is divided into upper and lower two stages. Hereinafter, the upper side of the case accommodation portion 60 is referred to as a "first accommodation portion 60*a*", and the lower side is referred to as a "second accommodation portion 60*b*". A plurality of first cases 61*a* having a small width among the cases 61 are accommodated in the first accommodation portion 60*a* in a state of being disposed in a row in the lateral direction, and a second case 61*b* having a large width is accommodated in the second accommodation portion 60*b*. In the example of FIG. 2, three first cases 61*a* are accommodated in the first accommodation portion 60*a*, and one second case 61*b* is accommodated in the second accommodation portion 60*b*.

Figure 3A:
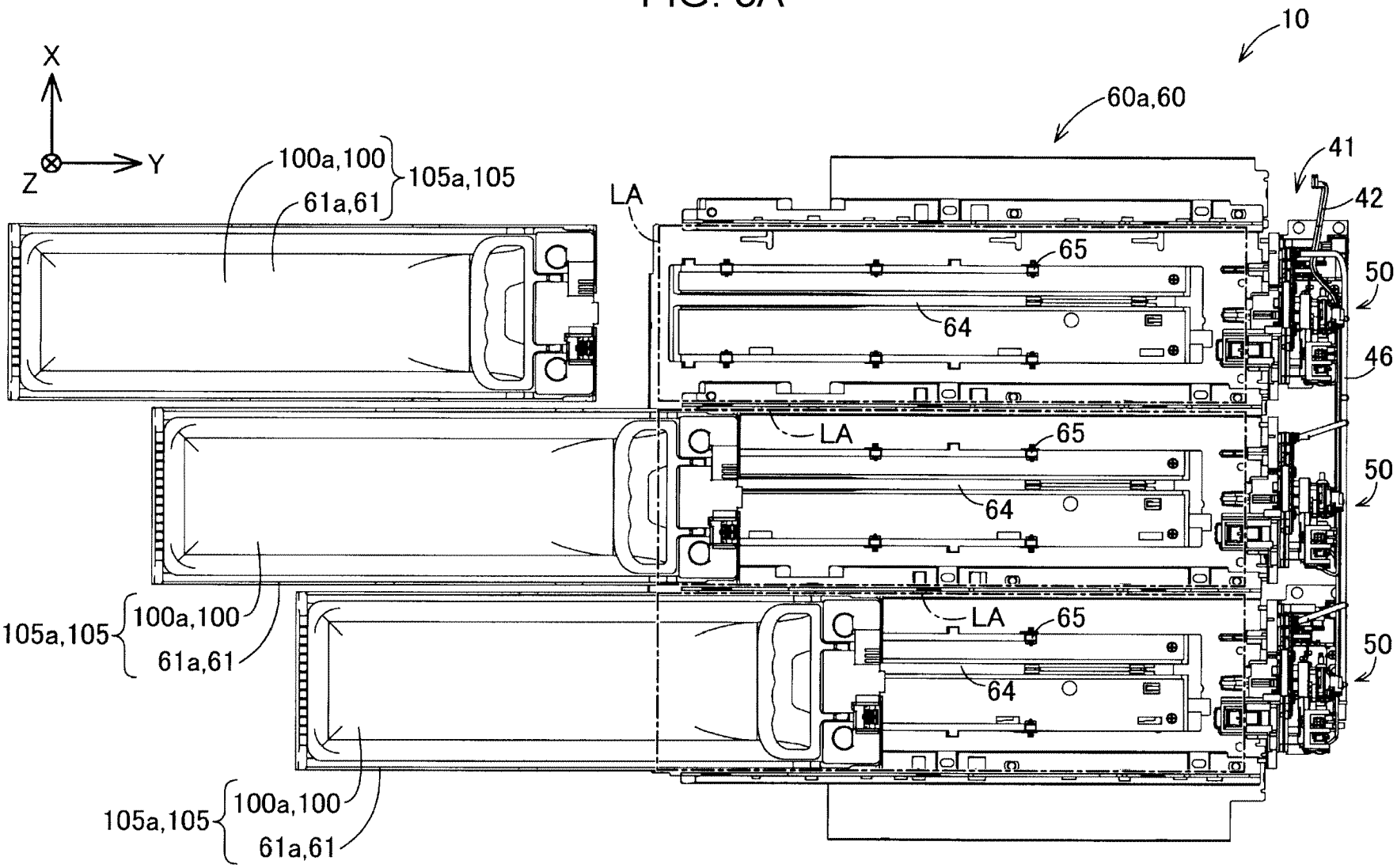
FIG. 3A is a schematic plan view illustrating a configuration of a first accommodation portion.
Figure 3B:
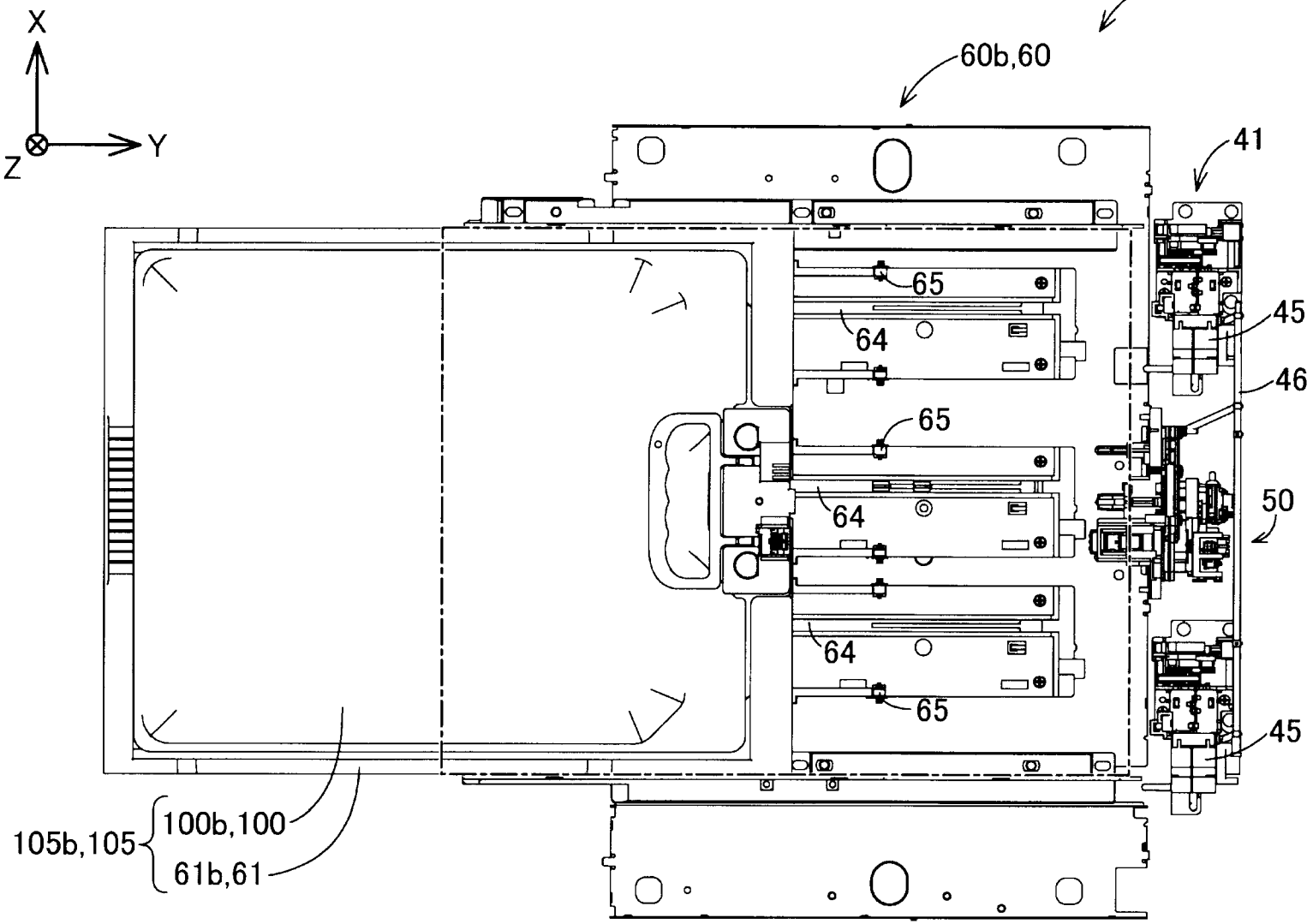
FIG. 3B is a schematic plan view illustrating a configuration of a second accommodation portion.

FIG. 3A is a schematic plan view when the first accommodation portion 60*a* is viewed from above in plan view, and FIG. 3B is a schematic plan view when the second accommodation portion 60*b* is viewed from above in plan view. FIGS. 3A and 3B respectively illustrate a disposition region LA, which is a disposition position when the mounting of the cases 61*a* and 61*b* in each of the accommodation portions 60*a* and 60*b* is completed, by a dashed line. In addition, in FIGS. 3A and 3B illustrate, for convenience, a state where each mounting body 105 is drawn out from the disposition region LA to the front side of the liquid container 100.

The first liquid container 100*a* having a small width among the liquid container 100 is mounted on the first case 61*a* accommodated in the first accommodation portion 60*a*, and the second liquid container 100*b* having a large width is mounted on the second case 61*b* accommodated in the second accommodation portion 60*b*. Hereinafter, the mounting body 105 configured to include the first case 61*a* and the first liquid container 100*a* is also referred to as a "first mounting body 105*a*", and the mounting body 105 configured to include the second case 61*b* and the second liquid container 100*b* is referred to as a "second mounting body 105*b*". In the present specification, each of the cases 61*a* and 61*b* is collectively referred to as the case 61 when it is not necessary to particularly determine these cases. Similarly, the liquid containers 100*a* and 100*b* and the mounting bodies 105*a* and 105*b* are collectively referred to as the liquid container 100 and the mounting body 105.

In the present embodiment, different color inks are contained in the plurality of liquid containers 100, respectively. The combination of the color inks contained in each of the liquid containers 100 is not particularly limited. For example, the three first liquid containers 100*a* may respectively contain cyan, magenta, and yellow, and the second liquid container 100*b* may contain black, which is expected to consume the largest amount. A portion or all of the liquid container 100 may contain the same color ink.

The case 61 can be attached to and detached from the liquid ejecting apparatus 10 by moving the case 61 in the front and rear direction with respect to the case accommodation portion 60. The case 61 can be set in the case accommodation portion 60 even in an empty state where the liquid container 100 is not disposed. The liquid container 100 is attachably and detachably disposed on the case 61 drawn out from the case accommodation portion 60. The attachment and detachment of the liquid container 100 to and from the liquid ejecting apparatus 10 is performed in a state where the liquid container 100 is disposed in the case 61. The liquid container 100 is mounted on the liquid container 100 by moving in the +Y direction described later in each of the accommodation portions 60*a* and 60*b*.

A plurality of rail grooves 64 are formed on a floor surface of each of the accommodation portions 60*a* and 60*b*. Each of the rail grooves 64 is formed linearly in the front and rear direction for each disposition region LA of each liquid container 100. A rail rib described later provided on the lower surface of the case 61 is fitted into each rail groove 64. The rail groove 64 guides the movement of the case 61 inside the liquid ejecting apparatus 10, suppresses the displacement of the case 61 in the lateral direction, and simplifies the mounting of the liquid container 100 on the liquid ejecting apparatus 10. The configurations of the rail grooves 64 and the corresponding rail ribs may be different for each case 61 in order to prevent erroneous mounting. In addition, a portion or all of the rail groove 64 may be omitted.

A plurality of rollers 65 are provided on the floor surface of the case accommodation portion 60. Each roller 65 is appropriately dispersed and disposed in the front and rear direction for each disposition region LA of each liquid container 100. In the case accommodation portion 60, the rotation of each roller 65 reduces the movement resistance when the case 61 is moved in the front and rear direction, so that the user can smoothly move the case 61. The roller 65 may be omitted.

The liquid supply portion 40 is provided with a liquid supply mechanism 41 for supplying the liquid in each liquid container 100 to the ejection execution portion 30. As illustrated in FIGS. 3A and 3B, the liquid supply mechanism 41 is provided at a deepest position of each of the accommodation portions 60*a* and 60*b*.

Figure 4:
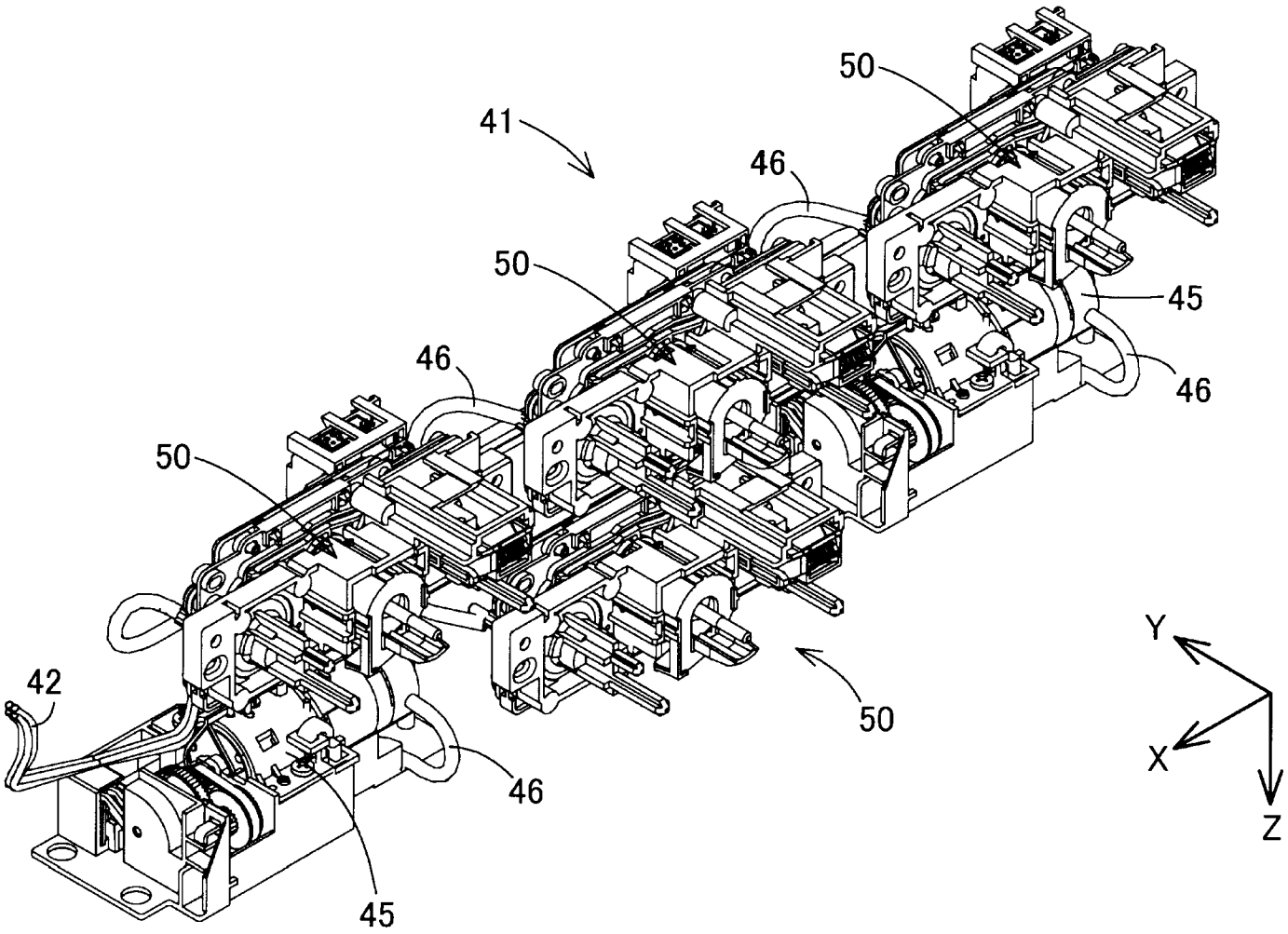
FIG. 4 is a schematic perspective view illustrating a liquid supply mechanism extracted therefrom.

FIG. 4 is a schematic perspective view illustrating the liquid supply mechanism 41 extracted therefrom. The liquid supply mechanism 41 is provided with a plurality of coupling receiving portions 50, a fluctuating pressure generation portion 45, and a pressure transmission pipe 46, in addition to the plurality of supply pipes 42 and the joint portion 43 described above. The liquid supply mechanism 41 is coupled to each of the plurality of liquid containers 100 accommodated in the case accommodation portion 60 through the plurality of coupling receiving portions 50.

In the present embodiment, the liquid supply mechanism 41 is provided with four coupling receiving portions 50 corresponding to the four liquid containers 100 accommodated in the case accommodation portion 60, respectively, as illustrated in FIG. 4. As illustrated in FIGS. 3A and 3B, one coupling receiving portion 50 is provided for each disposition region LA of each case 61. In the upper stage of the liquid supply mechanism 41, three coupling receiving portions 50 for the first accommodation portion 60*a* are disposed in a row at substantially equal intervals in the lateral direction. In addition, in the lower stage of the liquid supply mechanism 41, one coupling receiving portion 50 for the second accommodation portion 60*b* is disposed at the center.

Figure 5:
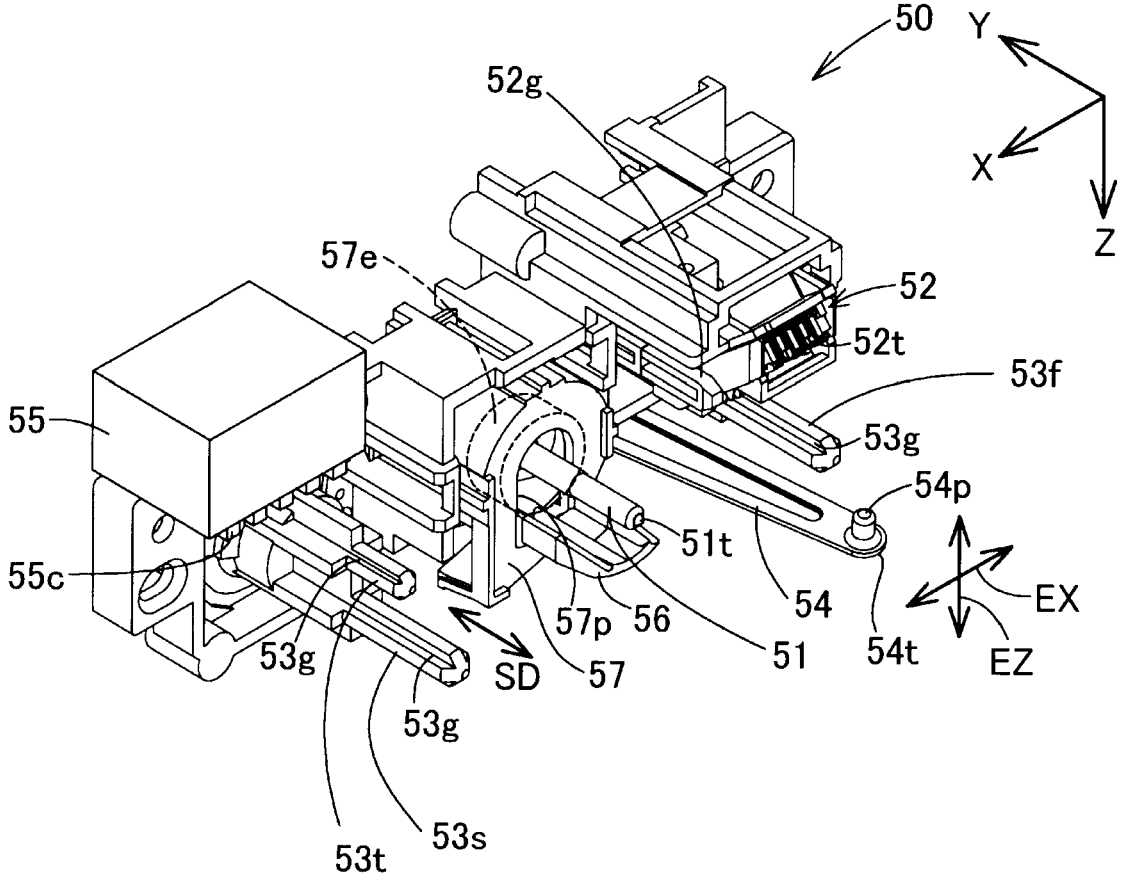
FIG. 5 is a schematic perspective view illustrating a coupling receiving portion.

FIG. 5 is a schematic perspective view illustrating the coupling receiving portion 50 extracted therefrom. The coupling receiving portion 50 is configured as one component in which a liquid introduction portion 51, an apparatus-side electrical coupling portion 52, a first positioning portion 53*f*, a second positioning portion 53*s*, a third positioning portion 53*t*, and an apparatus-side fixing structure 54 are integrated. The liquid introduction portion 51 is coupled to a liquid supply port described later of the liquid container 100, and causes the liquid to flow out from the liquid container 100. The liquid introduction portion 51 is formed of a needle-like pipe portion that extends linearly in the front and rear direction, and has an opening at a tip end portion 51*t* on the disposition region LA. The liquid introduction portion 51 is coupled to the liquid container 100 by inserting the tip end portion 51*t* into a liquid supply port of the liquid container 100.

A rear end portion of the liquid introduction portion 51 communicates with a pump chamber (not illustrated) provided inside the coupling receiving portion 50. The liquid flowed into the liquid introduction portion 51 flows into the pump chamber. Although not illustrated, a check valve structure is provided inside the coupling receiving portion 50 to prevent the liquid flowed into the pump chamber from flowing back to the liquid introduction portion 51 again.

In the coupling receiving portion 50 of the present embodiment, a liquid receiving portion 56 is provided below the liquid introduction portion 51. The liquid receiving portion 56 extends in the front and rear direction along the liquid introduction portion 51. The liquid receiving portion 56 is slightly curved downward along the lower side surface shape of the liquid introduction portion 51, and functions as a receiving tray for receiving liquid leaked from a coupling portion between the liquid introduction portion 51 and the liquid container 100. The liquid receiving portion 56 may be omitted.

A base end member 57 is provided at the rear end portions of the liquid introduction portion 51 and the liquid receiving portion 56. The base end member 57 is a resin member having a through-hole 57*p* through which the liquid introduction portion 51 is inserted. The base end member 57 is attached so as to be movable in the front and rear direction. A helical spring, which is an biasing member 57*e*, is disposed on the rear surface of the base end member 57 so as to surround the periphery of the liquid introduction portion 51, and applies elastic force in the front and rear direction to the base end member 57. Since the biasing member 57*e* is hidden behind the base end member 57 and cannot be seen, the disposition position thereof is illustrated by a broken line in FIG. 5. Due to the force applied by the biasing member 57*e*, the base end member 57 elastically moves in the front and rear direction as indicated by an arrow SD. When the mounting body 105 is mounted on the liquid ejecting apparatus 10, the mounting body 105 is applied with a forward force from the biasing member 57*e* through the base end member 57, that is, a force in the −Y direction.

When the coupling receiving portion 50 is viewed from the front to the rear in plan view, an apparatus-side electrical coupling portion 52 is provided on the right side of the liquid introduction portion 51. The apparatus-side electrical coupling portion 52 is a connector electrically coupled to the liquid container 100. The apparatus-side electrical coupling portion 52 has a plurality of terminal portions 52*t* disposed in the lateral direction. Each terminal portion 52*t* protrudes from the front surface of the apparatus-side electrical coupling portion 52, and electrically contacts a later-described container-side electrical coupling portion of the liquid container 100. It is desirable that each terminal portion 52*t* is biased in a protruding direction by an elastic member such as a leaf spring. In the present embodiment, the apparatus-side electrical coupling portion 52 is disposed at an inclination angle corresponding to a disposition angle of the container-side electrical coupling portion of the liquid container 100. In the present embodiment, the apparatus-side electrical coupling portion 52 is disposed obliquely so as to face obliquely downward.

The apparatus-side electrical coupling portion 52 is coupled to the control portion 20 illustrated in FIG. 2 through a wiring (not illustrated). The wiring is configured to include, for example, a flexible flat cable. The control portion 20 communicates an electric signal with the liquid container 100 by electrically coupling the apparatus-side electrical coupling portion 52 and the container-side electrical coupling portion. By this communication, the control portion 20 electrically detects a coupling state of the liquid container 100. In addition, the control portion 20 obtains information on the liquid contained in the liquid container 100 through this communication. The information on the liquid is, for example, the color of the ink, the type of the ink, the amount of the liquid contained in the liquid container 100, and the like.

On both sides in the lateral direction of the apparatus-side electrical coupling portion 52, one guide projection portion 52*g* is provided. In FIG. 5, for convenience, only the guide projection portion 52*g* on the center side is illustrated, and illustration of the outer guide projection portion 52*g* is omitted. The guide projection portion 52*g* is provided so as to protrude forward. The guide projection portion 52*g* functions as a positioning portion when the container-side electrical coupling portion of the liquid container 100 is coupled to the apparatus-side electrical coupling portion 52, as described later.

The first positioning portion 53*f*, the second positioning portion 53*s*, and the third positioning portion 53*t* respectively protrude forward at positions separated from each other. In the present embodiment, each of the positioning portions 53*f*, 53*s*, and 53*t* is configured as a shaft-like portion extending in the front and rear direction, and extends toward the disposition region LA in parallel with the liquid introduction portion 51. When facing the coupling receiving portion 50 from the front to the rear, the first positioning portion 53*f* is located on the right side of the liquid introduction portion 51, and the second positioning portion 53*s* and the third positioning portion 53*t* are located on the left side of the liquid introduction portion 51. The first positioning portion 53*f* is located below the apparatus-side electrical coupling portion 52. The second positioning portion 53*s* and the third positioning portion 53*t* are disposed side by side in the vertical direction below a fitting structure 55 described later.

The first positioning portion 53*f* and the second positioning portion 53*s* are provided at substantially the same height, and the second positioning portion 53*s* is located below the third positioning portion 53*t*. The first positioning portion 53*f* and the second positioning portion 53*s* are provided at positions lower than these of the liquid introduction portion 51 and the apparatus-side electrical coupling portion 52. The first positioning portion 53*f* and the second positioning portion 53*s* protrude toward the disposition region LA from the tip end portion 51*t* of the liquid introduction portion 51. The tip end portion of the third positioning portion 53*t* is located behind the tip end portion 51*t* of the liquid introduction portion 51.

When the liquid container 100 is properly mounted on the liquid ejecting apparatus 10, each of the positioning portions 53*f*, 53*s*, and 53*t* is inserted into a corresponding receiving portion described later provided in the liquid container 100. It is desirable that a groove portion 53*g* extending in the insertion direction is provided on the outer peripheral side surface of each of the positioning portions 53*f*, 53*s*, and 53*t*. As a result, the insertion of the positioning portions 53*f*, 53*s*, and 53*t* into the receiving portion of the liquid container 100 is facilitated.

An apparatus-side fixing structure 54 is provided on the right side of the liquid introduction portion 51 and below the apparatus-side electrical coupling portion 52 when facing the coupling receiving portion 50 from the front to the rear. The apparatus-side fixing structure 54 cooperates with a later-described case-side fixing structure provided in the case 61 in which the liquid container 100 is disposed, and regulates the case 61 after mounting is completed from moving in a direction away from the coupling receiving portion 50. In the present embodiment, the apparatus-side fixing structure 54 is configured as an arm-like member portion that extends toward the disposition region LA and enters below the mounting body 105.

The tip end portion 54*t* of the apparatus-side fixing structure 54 on the disposition region LA side protrudes toward the disposition region LA from the tip end portion 51*t* of the liquid introduction portion 51. In addition, the tip end portion 54*t* protrudes toward the disposition region LA from the tip end portions of the positioning portions 53*f*, 53*s*, and 53*t*. The tip end portion 54*t* is provided with a protrusion portion 54*p*. The protrusion portion 54*p* protrudes upward at the center of the tip end portion 54*t*. In the case accommodation state where the mounting of the case 61 on the case accommodation portion 60 is completed, the protrusion portion 54*p* is engaged with an engaged portion provided in a case-side fixing structure described later. In the following description, the protrusion portion 54*p* may also be referred to as an "engaging portion 54*p*". By locking the protrusion portion 54*p* to the engaged portion provided in the case-side fixing structure, the case 61 is regulated from moving in a direction away from the coupling receiving portion 50 by an elastic force received from the biasing member 57*e*.

As illustrated by the double-headed arrow EX, the apparatus-side fixing structure 54 is attached with the rear end portion as a fulcrum in a state where rotation in the lateral direction is allowed. The apparatus-side fixing structure 54 is elastically rotated in the lateral direction by an elastic member (not illustrated) disposed inside the coupling receiving portion 50. In addition, as illustrated by the double-headed arrow EZ, the apparatus-side fixing structure 54 is attached with the rear end portion as a fulcrum in a state where rotation in the vertical direction is allowed. The apparatus-side fixing structure 54 is biased in the vertical direction by an elastic member (not illustrated) disposed inside the coupling receiving portion 50, and elastically rotates in the vertical direction when the apparatus-side fixing structure 54 receives an external force in the vertical direction. In the process of mounting the case 61 on the case accommodation portion 60, the protrusion portion 54*p* of the apparatus-side fixing structure 54 is displaced in the groove of the case-side fixing structure while receiving the elastic force from the elastic member, and when reaching the engaged portion of the case-side fixing structure, the engaged portion is locked in a state of applying the elastic force.

The coupling receiving portion 50 of the present embodiment is further provided with a fitting structure 55. The fitting structure 55 is provided on the left side of the liquid introduction portion 51 when facing the mounting direction of the liquid container 100. The fitting structure 55 is provided above the second positioning portion 53*s* and the third positioning portion 53*t*. The fitting structure 55 is provided on the rear side of the tip end portion of each of the positioning portions 53*f*, 53*s*, and 53*t*. The fitting structure 55 has an uneven structure in which a plurality of substantially rectangular protrusion portions 55*c* are disposed on the lower surface. The arrangement pattern of the protrusion portions 55*c* in the uneven structure of the fitting structure 55 is different for each coupling receiving portion 50 of the case accommodation portion 60. The liquid container 100 corresponding to each of the coupling receiving portions 50 is provided with a fitting structure receiving portion which is described later and has an uneven structure capable of fitting, corresponding to the arrangement pattern of the uneven structure. As a result, it is suppressed that a wrong liquid container 100 which does not correspond is coupled to the coupling receiving portion 50.

Please refer to FIG. 4. The plurality of supply pipes 42 of the liquid supply mechanism 41 are formed of flexible resin tube members. Each of the supply pipes 42 is coupled to the above-described pump chambers provided inside each of the coupling receiving portions 50 one by one. As illustrated in FIG. 2, each of the supply pipes 42 is routed upward from the case accommodation portion 60 through the side of the medium transport portion 35 and coupled to the joint portion 43 installed at a position higher than that of the medium transport portion 35. As described above, each of the supply pipes 42 is coupled to a corresponding tube of the plurality of tubes 32 included in the ejection execution portion 30 through the joint portion 43.

Please refer to FIG. 4. The fluctuating pressure generation portion 45 is provided beside the coupling receiving portion 50 disposed in the second accommodation portion 60*b*. The fluctuating pressure generation portion 45 is a source that generates a pressure fluctuation for sucking and delivering the liquid, and is configured to include, for example, a pump. A pressure transmission pipe 46 is coupled to the fluctuating pressure generation portion 45. The pressure transmission pipe 46 transmits the pressure fluctuation generated by the fluctuating pressure generation portion 45 to a pressure chamber (not illustrated) provided inside each coupling receiving portion 50.

The pressure chamber of each coupling receiving portion 50 is adjacent to the above-described pump chamber into which the liquid flows from the liquid container 100 with the flexible membrane interposed therebetween. When the fluctuating pressure generation portion 45 reduces the pressure in the pressure chamber, the flexible membrane bends toward the pressure chamber, the volume of the pump chamber increases, and the liquid in the liquid container 100 is sucked into the pump chamber through the liquid introduction portion 51. On the other hand, when the fluctuating pressure generation portion 45 increases the pressure in the pressure chamber, the flexible membrane bends toward the pump chamber, the volume of the pump chamber decreases, and the liquid flowing into the pump chamber is pushed out to the supply pipe 42. As described above, in the liquid supply portion 40, the supply of the liquid to the ejection execution portion 30 is realized by the fluctuating pressure generation portion 45 repeating the rise and fall of the pressure in the pressure chamber.

1-2. Configuration of First Liquid Container and First Case

With reference to FIGS. 6 to 11, the configuration of the first liquid container 100*a* and the first case 61*a* that form the first mounting body 105*a* will be described. FIGS. 6 to 11 illustrate arrows indicating three X direction, Y direction, and Z direction orthogonal to each other in the liquid container 100. The X direction corresponds to a width direction of the liquid container 100, the Y direction corresponds to a length direction of the liquid container 100, and the Z direction corresponds to a height direction of the liquid container 100. In this specification, the positive directions of the X direction, the Y direction, and the Z direction are referred to as +X direction, +Y direction, and +Z direction, respectively, and the negative directions are referred to as −X direction, −Y direction, and −Z direction. The +Y direction corresponds to the moving direction when the liquid container 100 is mounted on the liquid ejecting apparatus 10, and the −Y direction corresponds to the moving direction when the liquid container 100 is removed from the liquid ejecting apparatus 10. In a mounted state where the liquid container 100 is mounted on the liquid ejecting apparatus 10 in a normal use state, the +Z direction corresponds to a downward direction, and the −Z direction corresponds to an upward direction. In addition, when the liquid container 100 is mounted on the liquid ejecting apparatus 10 in a normal use state, the +X direction corresponds to the right direction and the −X direction corresponds to the left direction when the liquid container 100 is viewed in plan view in the −Y direction. Arrows indicating the X direction, the Y direction, and the Z direction are similarly illustrated in each of the drawings referred to later.

Figure 6:
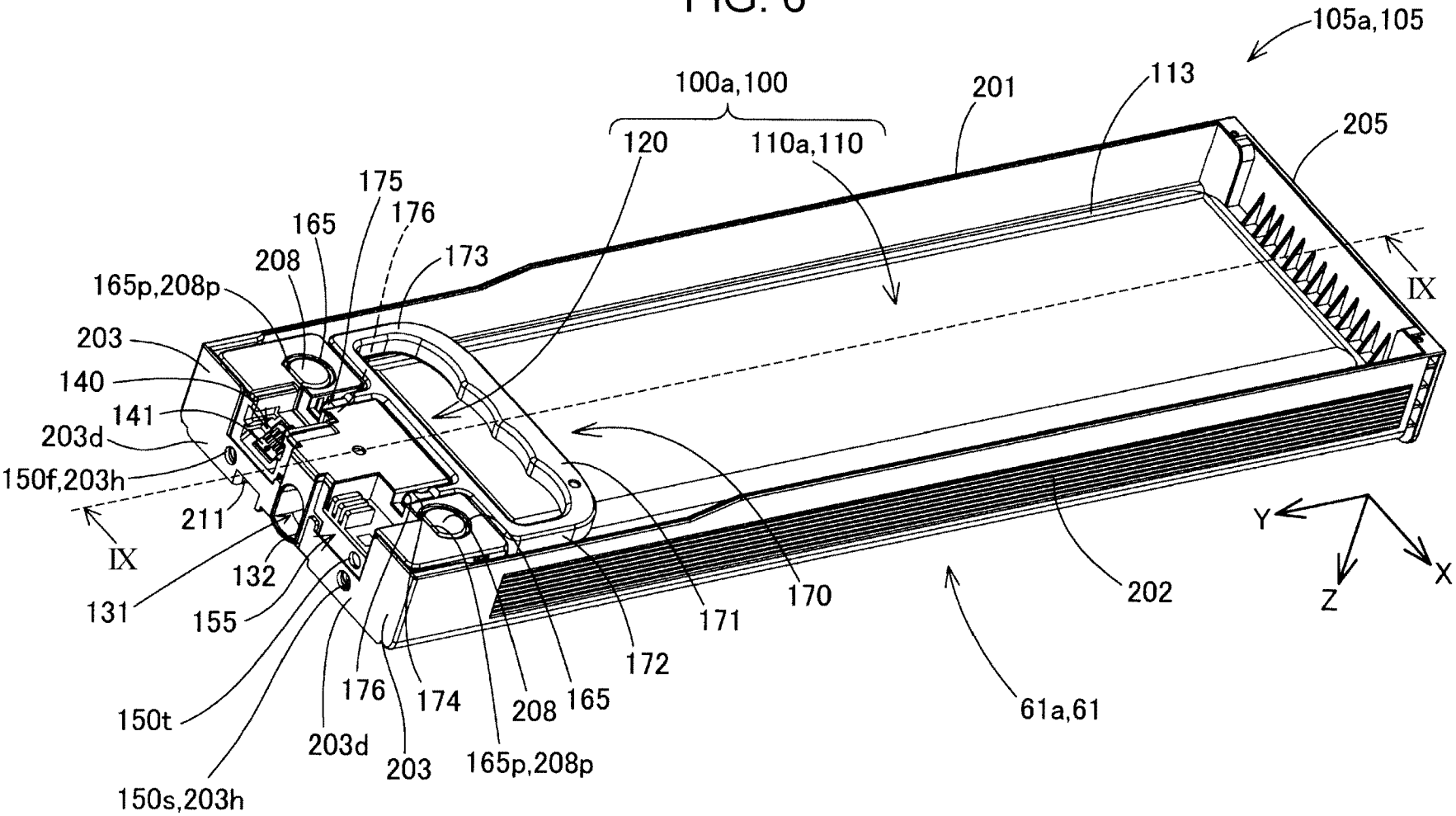
FIG. 6 is a schematic perspective view illustrating a front surface of a first mounting body.
Figure 7:
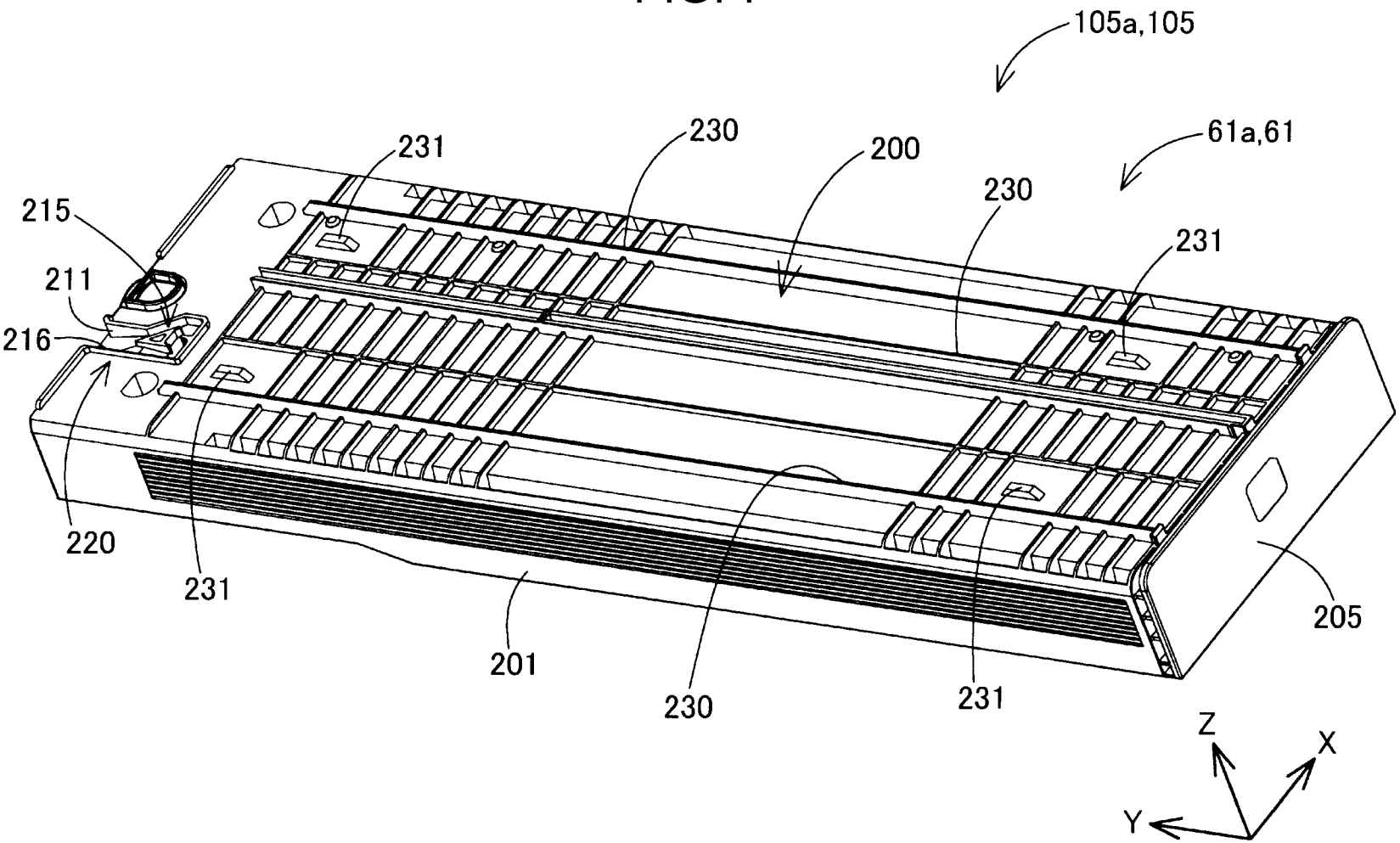
FIG. 7 is a schematic perspective view illustrating a rear surface of the first mounting body.
Figure 8:
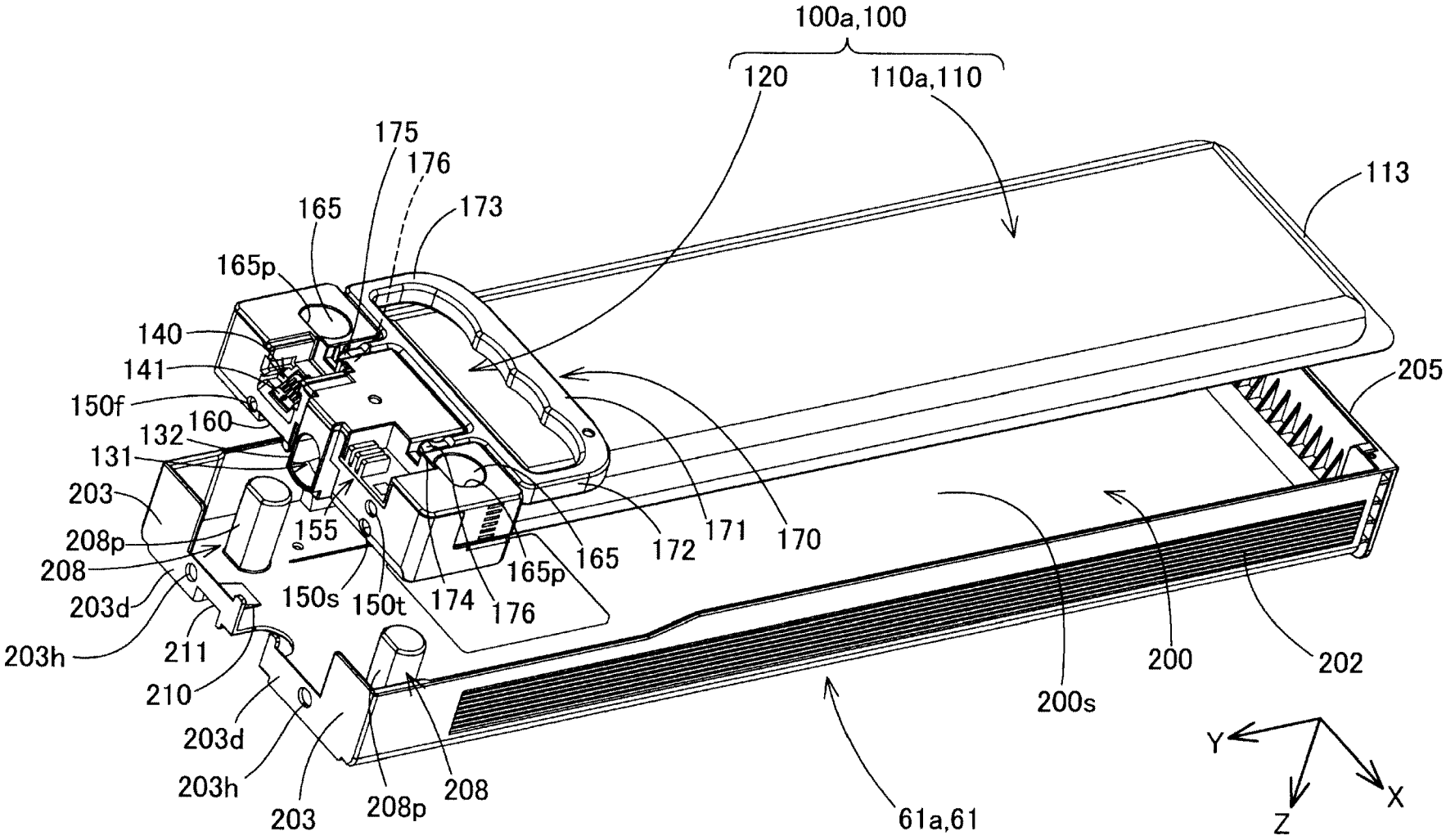
FIG. 8 is a schematic exploded perspective view of the first mounting body.
Figure 9:
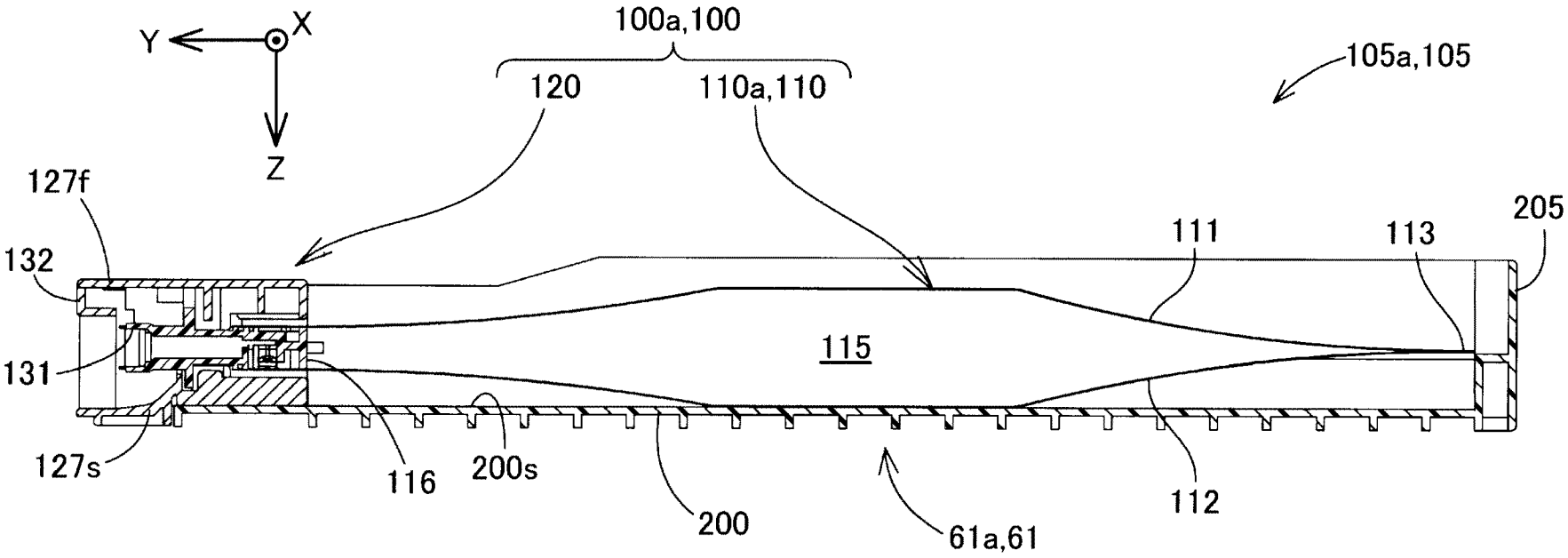
FIG. 9 is a schematic sectional view of the first mounting body.
Figure 10:
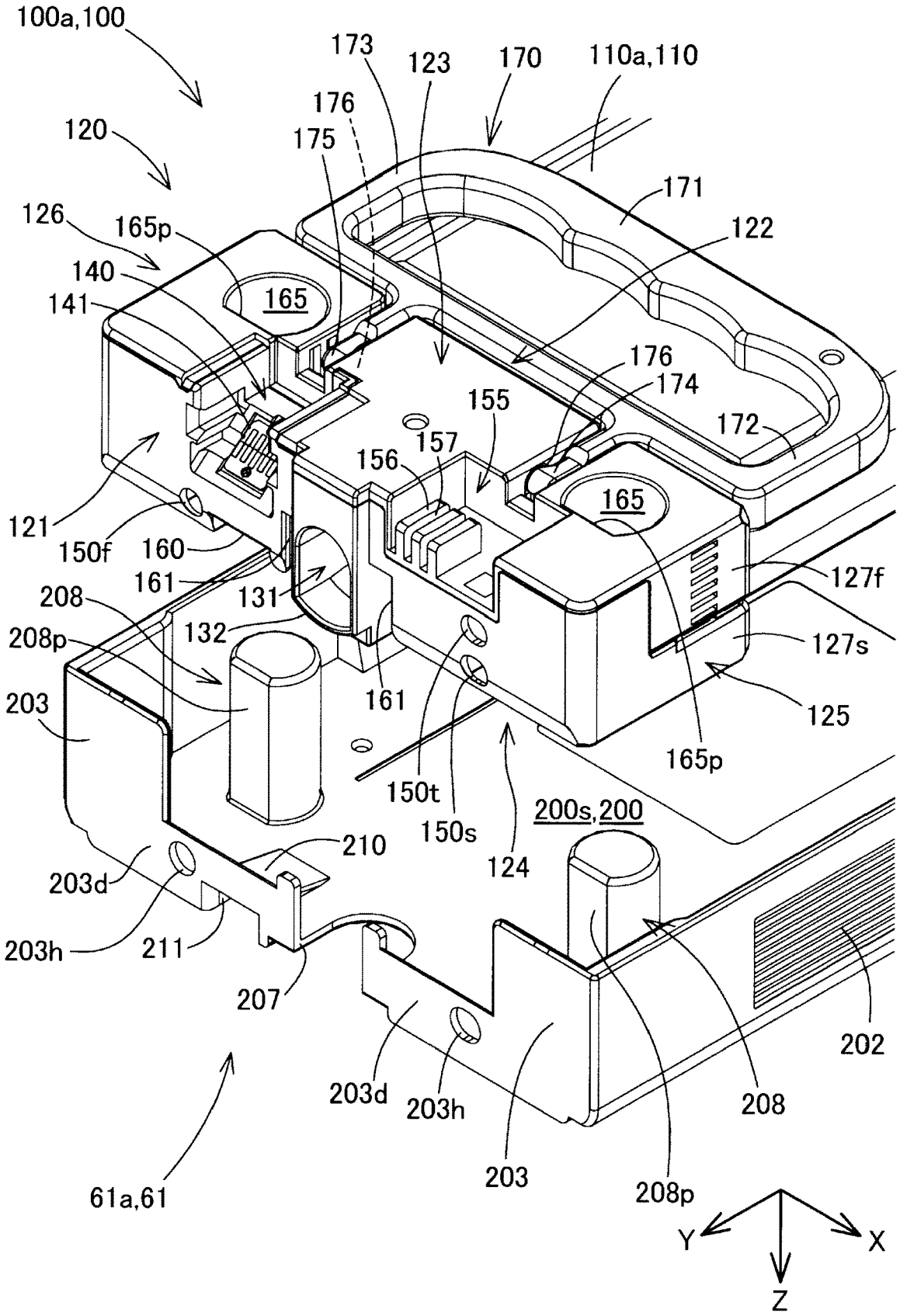
FIG. 10 is a schematic perspective view of a first liquid container and a tip end portion of a first case, which are extracted therefrom.
Figure 11:
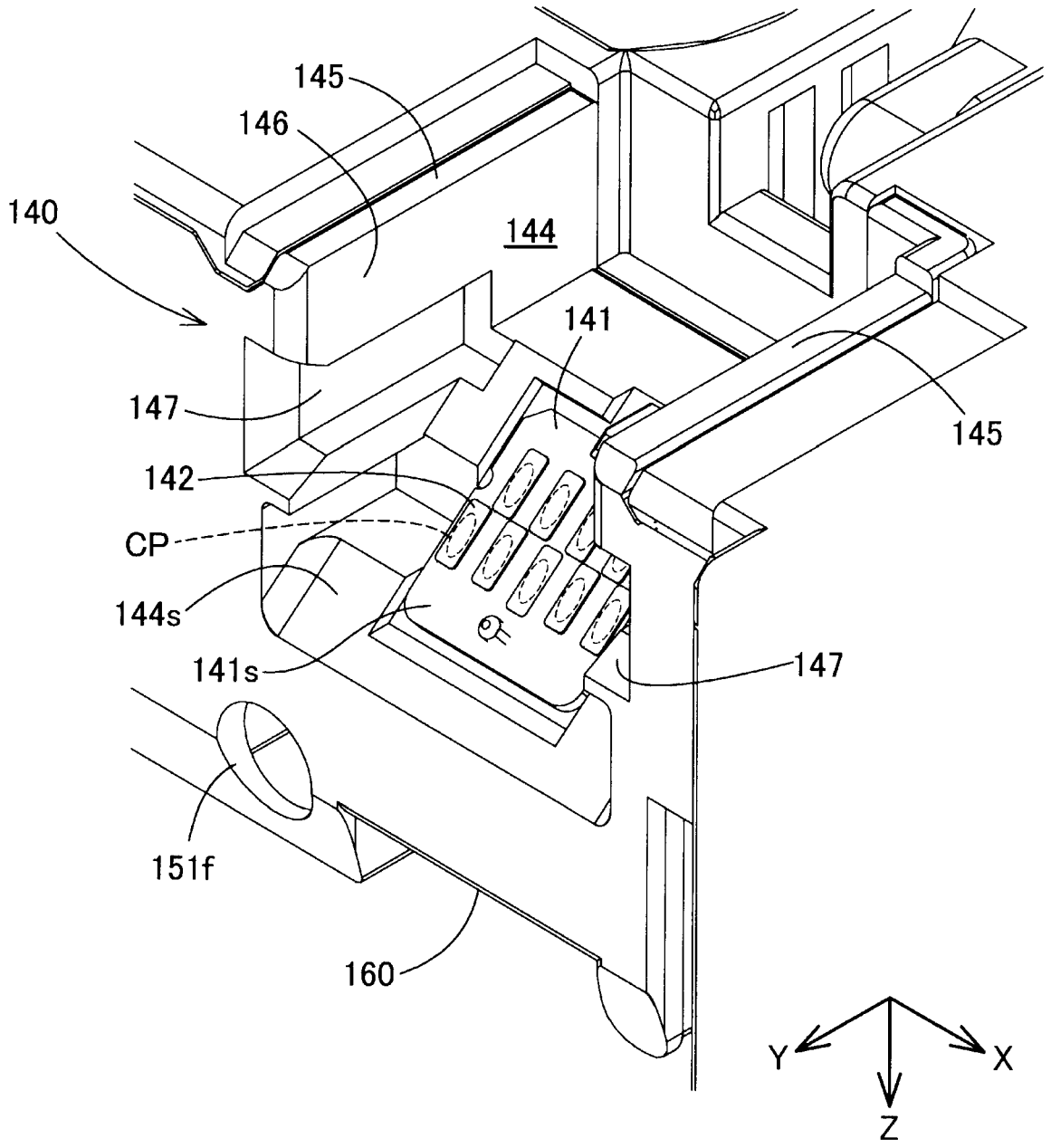
FIG. 11 is a schematic perspective view illustrating a vicinity of a container-side electrical coupling portion extracted therefrom.

FIG. 6 is a schematic perspective view illustrating the front surface of the first mounting body 105*a*. FIG. 7 is a schematic perspective view illustrating the rear surface of the first mounting body 105*a*. FIG. 8 is a schematic exploded perspective view of a state where the first liquid container 100*a* is taken out from the first case 61*a* when viewed on the −Z direction side. FIG. 9 is a schematic sectional view of the first mounting body 105*a* taken along the line IX-IX illustrated in FIG. 6. FIG. 10 is a schematic perspective view illustrating the first liquid container 100*a* and the end portions on the +Y direction side of the first case 61*a*, which are extracted therefrom. FIG. 11 is a schematic perspective view illustrating a vicinity of the container-side electrical coupling portion 140 extracted therefrom.

Please refer to FIGS. 6 and 8. The first liquid container 100*a* is a so-called ink pack, and is provided with a bag-like member 110*a* and a coupling member 120. The first liquid container 100*a* has a substantially rectangular outer peripheral shape with the Y direction as the longitudinal direction when viewed in plan view in the +Z direction. The coupling member 120 forms an end portion of the first liquid container 100*a* on the +Y direction side, and the bag-like member 110*a* is located on the −Y direction side of the coupling member 120.

The dimension in the Z direction of the first liquid container 100*a* is smaller than the dimension in the X direction and the dimension in the Y direction. The "dimension" means the distance in the direction between the outermost portions of the first liquid container 100*a* in each direction. That is, the first liquid container 100*a* has a thin flat plate shape. Since the first liquid container 100*a* has such a shape, a disposition posture on the first case 61*a* is stabilized.

The bag-like member 110*a* is a containing body in which a liquid containing portion 115 for containing a liquid is configured. When viewed in the Z direction, the liquid containing portion 115 inside the bag-like member 110*a* has a substantially rectangular shape whose longitudinal direction is the same as that of the bag-like member 110*a* in the Y direction. The dimension of the bag-like member 110*a* in the X direction is substantially the same as the dimension of the coupling member 120 in the X direction.

The bag-like member 110*a* has flexibility. The flexibility of the bag-like member 110*a* may be such that the bag-like member 110*a* bends by its own weight, or may be such that the bag-like member 110*a* retains the shape with respect to its own weight and bends when a load greater than that of its own weight is applied. When viewed in the Z direction, the bag-like member 110*a* has a substantially rectangular shape whose longitudinal direction is the Y direction.

As illustrated in FIG. 9, the bag-like member 110*a* is configured by overlapping two sheet members 111 and 112 in the Z direction and welding their outer peripheral end portions 113. The first sheet member 111 is disposed on the −Z direction side, and forms an upper surface of the bag-like member 110*a*. The second sheet member 112 is disposed on the +Z direction side, and forms a lower surface of the bag-like member 110*a*. Each of the sheet members 111 and 112 has a rectangular shape having the same size as each other. Each of the sheet members 111 and 112 may not have a completely planar shape. Each of the sheet members 111 and 112 is desirably formed in a bent shape such that a swelling is gradually formed toward the center of the bag-like member 110*a*.

Each of the sheet members 111 and 112 is formed of a material having flexibility, gas barrier properties, and liquid impermeability. Each of the sheet members 111 and 112 may be made of, for example, a film member such as polyethylene terephthalate (PET), nylon, or polyethylene. Each of the sheet members 111 and 112 may be formed by laminating a plurality of films made of the above-described materials. In this case, for example, the outer layer may be formed of a PET or nylon film having excellent impact resistance, and the inner layer may be formed of a polyethylene film having excellent ink resistance. Furthermore, a layer in which aluminum or the like is deposited may be added to the laminated structure.

A supply port member 116 having a liquid supply port 131 is attached to an end portion of the bag-like member 110*a* on the +Y direction side. A liquid flow path that communicates the liquid supply port 131 and the liquid containing portion 115 is provided inside the supply port member 116. A skeletal member for maintaining the shape of the liquid containing portion 115 and a tubular member coupled to the supply port member 116 for guiding the liquid in the liquid containing portion 115 to the outside of the bag-like member 110*a*, and the like are contained inside the bag-like member 110*a*. In FIG. 9, illustration of such a structure in the liquid containing portion 115 is omitted.

As illustrated in FIG. 8, the coupling member 120 is attached to the end portion of the bag-like member 110*a* on the +Y direction side. The coupling member 120 is fixed to an end portion on the tip end side in the mounting direction of the first mounting body 105*a*. The coupling member 120 has a function of coupling to the corresponding coupling receiving portion 50 and a function of fixing the first liquid container 100*a* to the first case 61*a*.

Figure 15:
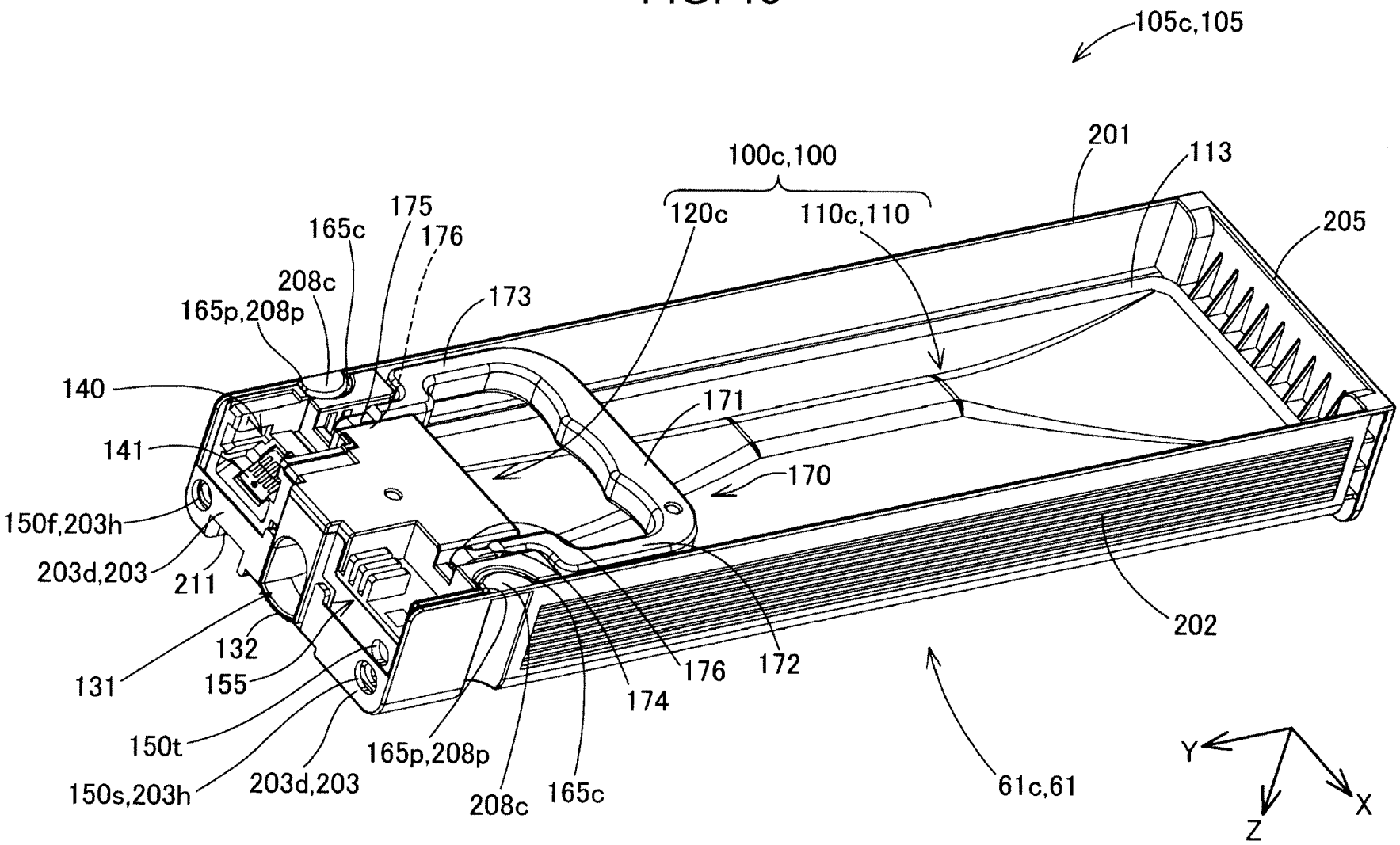
FIG. 15 is a schematic perspective view illustrating a front surface of a mounting body according to a second embodiment.

Please refer to FIG. 10. The coupling member 120 has a substantially rectangular parallelepiped shape whose longitudinal direction is the X direction. A main body portion of the coupling member 120 is produced, for example, by molding a resin member such as polypropylene. The coupling member 120 includes a first surface portion 121, a second surface portion 122, a third surface portion 123, a fourth surface portion 124, a fifth surface portion 125, and a sixth surface portion 126 (FIG. 15). In the present specification, the "surface portion" may not be configured in a planar shape, may be configured in a curved shape, or may have a recessed portion or a projection portion, a step, a groove, a bent portion, an inclined surface, and the like. In addition, the term "intersecting" between two surface portions means either a state where the two surface portions actually intersect each other, a state where the extension surface of one surface portion intersects the other surface portion, or a state where the extension surfaces of the two surface portions intersect each other. A curved surface for smoothly coupling each surface portion or a surface obliquely intersecting each surface portion may be interposed between adjacent surface portions.

The first surface portion 121 faces in the +Y direction, and forms a tip end portion surface in the mounting direction of the first liquid container 100*a* with respect to the liquid ejecting apparatus 10. The first surface portion 121 faces the coupling receiving portion 50 in the case accommodation portion 60. As described later, components for coupling to the coupling receiving portion 50 are disposed on the first surface portion 121 side of the coupling member 120. The second surface portion 122 is located at a position facing the first surface portion 121 and faces in the −Y direction. The second surface portion 122 forms a rear end surface in the mounting direction of the first liquid container 100*a*. The above-described bag-like member 110*a* is fixed to the second surface portion 122. The third surface portion 123 intersects the first surface portion 121 and the second surface portion 122, and faces in the −Z direction. The third surface portion 123 forms an upper surface portion of the coupling member 120. A handle 170 for improving the maneuverability of the first liquid container 100*a* is attached to the third surface portion 123.

The fourth surface portion 124 is located at a position facing the third surface portion 123 and intersects the first surface portion 121 and the second surface portion 122. The fourth surface portion 124 is a surface portion on the +Z direction side, faces the +Z direction, and forms a bottom surface portion of the coupling member 120. The fifth surface portion 125 intersects the first surface portion 121, the second surface portion 122, the third surface portion 123, and the fourth surface portion 124. The fifth surface portion 125 faces in the +X direction and forms a right side surface portion of the coupling member 120 when viewing the coupling member 120 in the −Y direction. The sixth surface portion 126 is located at a position facing the fifth surface portion 125, and intersects the first surface portion 121, the second surface portion 122, the third surface portion 123, and the fourth surface portion 124. The sixth surface portion 126 faces in the −X direction and forms a left side surface portion of the coupling member 120 when viewing the coupling member 120 in the −Y direction.

Please refer to FIGS. 9 and 10. The coupling member 120 includes a first member 127*f* and a second member 127*s* that are overlapped in the Z direction. The above-described supply port member 116 is held in the coupling member 120 by being interposed between the first member 127*f* and the second member 127*s*. In addition, the bag-like member 110*a* is fixed to the coupling member 120 with the end portion on the +Y-direction side interposed between the first member 127*f* and the second member 127*s* in the Z-direction.

Please refer to FIGS. 8 and 10. The coupling member 120 is provided with a liquid supply port 131, a container-side electrical coupling portion 140, a first receiving portion 150*f*, a second receiving portion 150*s*, a third receiving portion 150*t*, and a fitting structure receiving portion 155, as components for coupling to the coupling receiving portion 50. In the following, after describing these components in order, other components provided in the coupling member 120 will be described.

The liquid supply port 131 is an opening portion that opens in the +Y direction. The central axis of the liquid supply port 131 is parallel to the Y direction. The liquid introduction portion 51 of the coupling receiving portion 50 illustrated in FIG. 5 is inserted into the liquid supply port 131 in the −Y direction. The liquid supply port 131 is provided at a substantially central position in the X direction on the first surface portion 121. As illustrated in FIG. 9, the liquid supply port 131 is formed at substantially the same height as the position where the bag-like member 110*a* is fixed.

Please refer to FIG. 9. The liquid supply port 131 communicates with the liquid containing portion 115 through a flow path in the supply port member 116 and a tubular member (not illustrated) coupled to the supply port member 116. A detailed description of the configuration of the liquid flow path in the first liquid container 100*a* will be omitted. Although not illustrated, the inside of the coupling member 120 is kept closed before the liquid introduction portion 51 is inserted into the liquid supply port 131 in order to prevent leakage of the liquid, and a valve structure or a seal structure that opens when the liquid introduction portion 51 is inserted is provided.

In the present embodiment, the liquid supply port 131 is open at a position deeper on the −Y direction side than a peripheral portion 132. As a result, the liquid supply port 131 is in a state of being surrounded by a wall portion formed by the peripheral portion 132, and the protection of the liquid supply port 131 is enhanced. Therefore, for example, the user is prevented from accidentally touching the liquid supply port 131. In addition, when the first liquid container 100*a* is accidentally dropped, the deterioration such as damage or deformation due to collision of the liquid supply port 131 is suppressed. Please refer to FIG. 9. When the liquid introduction portion 51 of the coupling receiving portion 50 is coupled to the liquid supply port 131, the peripheral portion 132 contacts a base end member 57 provided around the liquid introduction portion 51 illustrated in FIG. 5.

Please refer to FIG. 11. The container-side electrical coupling portion 140 is provided with a substrate portion 141 for coupling to the apparatus-side electrical coupling portion 52. The container-side electrical coupling portion 140 is in electrical contact with the apparatus-side electrical coupling portion 52 of the coupling receiving portion 50 illustrated in FIG. 5. A plurality of terminals 142 are disposed on a front surface 141*s* of the substrate portion 141. The plurality of terminals 142 are disposed at positions corresponding to the terminal portions 52*t* of the apparatus-side electrical coupling portion 52. Although illustration and detailed description are omitted, a storage device for storing information on the liquid, a circuit for detecting coupling of the apparatus-side electrical coupling portion 52, and the like are provided on a surface of the substrate portion 141 opposite to the front surface 141*s*.

In the present embodiment, each terminal 142 has a substantially planar contact surface with which the terminal portion 52*t* of the apparatus-side electrical coupling portion 52 comes into contact. In FIG. 11, the position of a contact portion CP of each terminal 142 where the terminal portion 52*t* of the apparatus-side electrical coupling portion 52 contacts is illustrated by a broken line. The contact portion CP of each of the terminals 142 is disposed in an arrangement direction parallel to the X direction on each of the upper stage and the lower stage on the front surface 141*s* of the substrate portion 141. The arrangement pattern of the terminals 142 and the contact portions CP is not limited to the arrangement pattern illustrated in FIG. 11.

The container-side electrical coupling portion 140 is provided on the −X direction side from the liquid supply port 131. The container-side electrical coupling portion 140 is provided with a substrate disposition portion 144 on which the substrate portion 141 is disposed. In the coupling member 120, the substrate disposition portion 144 is formed as a recessed portion that is depressed in the −Y direction and the +Z direction. The substrate disposition portion 144 has an inclined surface 144*s* faced in the +Y direction and the +Z direction, and the substrate portion 141 is disposed on the inclined surface 144*s* at a disposition angle substantially parallel to the inclined surface 144*s* in an inclined manner. As described above, the substrate portion 141 is disposed so that the front surface 141*s* faces on the −Z direction side. Therefore, when the apparatus-side electrical coupling portion 52 is electrically coupled, the container-side electrical coupling portion 140 comes into electrical contact with the apparatus-side electrical coupling portion 52 while receiving at least a downward force in the +Z direction from the apparatus-side electrical coupling portion 52. By this downward force, the contact state between the container-side electrical coupling portion 140 and the apparatus-side electrical coupling portion 52 is improved, and the electrical coupling of the container-side electrical coupling portion 140 is enhanced. In addition, when the container-side electrical coupling portion 140 is coupled to the apparatus-side electrical coupling portion 52, by utilizing the force for moving the first case 61*a* in the +Y direction, the container-side electrical coupling portion 140 and the apparatus-side electrical coupling portion 52 are brought into contact with each other so as to be pressed against each other in the Y direction, to form an electrical coupling state. Therefore, the electrical coupling between the container-side electrical coupling portion 140 and the apparatus-side electrical coupling portion 52 is enhanced. In addition, when coupling to the apparatus-side electrical coupling portion 52, the terminal portion 52*t* of the apparatus-side electrical coupling portion 52 moves while rubbing the contact surface of the terminal 142 of the container-side electrical coupling portion 140. As a result, foreign matter or the like attached to the contact surface of the terminal 142 of the container-side electrical coupling portion 140 is removed by the terminal portion 52*t* of the apparatus-side electrical coupling portion 52, so that the electrical coupling of the container-side electrical coupling portion 140 is further enhanced. In addition, when the mounting body 105 is taken out from the case accommodation portion 60, the movement of the mounting body 105 in the −Y direction is assisted by the force in the −Y direction received from the apparatus-side electrical coupling portion 52. Therefore, removal of the mounting body 105 from the case accommodation portion 60 is facilitated.

The substrate portion 141 is installed at a deep position of the substrate disposition portion 144. The substrate portion 141 is interposed between two wall portions 145 protruding from the front surface 141*s* of the substrate portion 141 in the −Z direction and the +Y direction on both sides in the X direction. These wall portions 145 function as protection portions for the substrate portion 141. Therefore, for example, it is possible to prevent the user from accidentally touching the substrate portion 141, and to prevent the substrate portion 141 from being damaged when the first liquid container 100*a* is accidentally dropped.

Each of the side wall surfaces 146 on both sides of the substrate disposition portion 144 interposing the substrate portion 141 in the X direction is provided with a groove-like guide recessed portion 147 along the Y direction one by one. The end portion of the guide recessed portion 147 on the +Y direction side is open. When the apparatus-side electrical coupling portion 52 is coupled to the container-side electrical coupling portion 140, the guide projection portions 52*g* illustrated in FIG. 5 provided on both sides in the X direction of the apparatus-side electrical coupling portion 52 are inserted into the corresponding guide recessed portion 147 in the −Y direction. As a result, the substrate portion 141 is positioned with respect to the apparatus-side electrical coupling portion 52.

Please refer to FIG. 10. The first receiving portion 150*f*, the second receiving portion 150*s*, and the third receiving portion 150*t* are provided on the first surface portion 121 of the coupling member 120. When the first liquid container 100*a* is mounted on the liquid ejecting apparatus 10, the first receiving portion 150*f* receives the first positioning portion 53*f* of the coupling receiving portion 50 illustrated in FIG. 5. The second receiving portion 150*s* receives the second positioning portion 53*s* of the coupling receiving portion 50. The third receiving portion 150*t* receives the third positioning portion 53*t* of the coupling receiving portion 50. In the present embodiment, each of the receiving portions 150*f*, 150*s*, and 150*t* is formed as a hole portion that opens in the Y direction. Each of the receiving portions 150*f*, 150*s*, and 150*t* receives the insertion of the corresponding positioning portion 53*f*, 53*s*, and 53*t* in the −Y direction.

The first receiving portion 150*f* is located on the −X direction side of the liquid supply port 131. The first receiving portion 150*f* is provided at a position different from the container-side electrical coupling portion 140 in the Z direction. The first receiving portion 150*f* is provided below the container-side electrical coupling portion 140. The second receiving portion 150*s* and the third receiving portion 150*t* are located on the +X direction side of the liquid supply port 131.

The second receiving portion 150*s* and the third receiving portion 150*t* are disposed side by side in the Z direction. In this specification, the fact that two objects are "disposed side by side" in a certain direction means a state where at least a portion of the two objects overlaps when viewed in the direction where the two objects are disposed side by side.

The first receiving portion 150*f* and the second receiving portion 150*s* are disposed side by side in the X direction. In addition, the third receiving portion 150*t* and the container-side electrical coupling portion 140 are disposed side by side in the X direction. Furthermore, the center of the first receiving portion 150*f* and the center of the second receiving portion 150*s* are located on the +Z direction side with respect to the center of the liquid supply port 131, and the center of the third receiving portion 150*t* and the container-side electrical coupling portion 140 are located on the −Z direction side with respect to the center of the liquid supply port 131.

Each of the receiving portions 150*f*, 150*s*, and 150*t* may not be configured such that the corresponding each of the positioning portion 53*f*, 53*s*, and 53*t* that receive insertion is fitted tightly. In the present embodiment, each of the receiving portions 150*f*, 150*s*, and 150*t* is configured such that the corresponding each of the positioning portion 53*f*, 53*s*, and 53*t* is fitted in a play state where a slight gap occurs. In addition, in the present embodiment, an opening width of the second receiving portion 150*s* in the X direction is larger than an opening width of the first receiving portion 150*f* in the X direction. Details of the effects of inserting each of the positioning portion 53*f*, 53*s*, and 53*t* corresponding to each of the receiving portion 150*f*, 150*s*, and 150*t* will be described later.

Please refer to FIG. 10. The fitting structure receiving portion 155 is provided on the +X direction side of the liquid supply port 131. The fitting structure receiving portion 155 is provided on a side opposite to the container-side electrical coupling portion 140 with the liquid supply port 131 interposed therebetween in the X direction. The fitting structure receiving portion 155 has an uneven structure in which a plurality of substantially rectangular protrusion portions 156 protruding in the −Z direction at the same height and extending in parallel in the −Y direction are disposed. The arrangement pattern in the X direction of the protrusion portions 156 of the fitting structure receiving portion 155 and the valley portions 157 as recessed portions formed therebetween has unevenness opposite to the arrangement pattern of the uneven structure of the fitting structure 55 illustrated in FIG. 5 to be coupled. When the first liquid container 100*a* is moved in the +Y direction and coupled to the corresponding coupling receiving portion 50, fitting between the uneven structure of the fitting structure 55 and the uneven structure of the fitting structure receiving portion 155 is allowed. On the other hand, when the combination of the first liquid container 100*a* and the coupling receiving portion 50 is not appropriate, the uneven structure of the fitting structure 55 does not match the uneven structure of the fitting structure receiving portion 155, and the fitting cannot be performed. Therefore, it is suppressed that the wrong first liquid container 100*a* that does not correspond is coupled to the coupling receiving portion 50.

Please refer to FIG. 10. The fourth surface portion 124 of the coupling member 120 is provided with the recessed portion 160 recessed in the −Z direction. The recessed portion 160 has a substantially rectangular shape, and opens at the lower end of the first surface portion 121 in the +Y direction. The recessed portion 160 is formed at a position overlapping the container-side electrical coupling portion 140 in the Z direction. When the first liquid container 100*a* is disposed in the first case 61*a*, the recessed portion 160 contains a projection portion 210 described later formed on the bottom surface of the first case 61*a*.

Please refer to FIG. 10. A pair of fitting recessed portions 161 are formed on the first surface portion 121 of the coupling member 120. The two fitting recessed portions 161 are disposed so as to interpose the liquid supply port 131 in the X direction. Each of the two fitting recessed portions 161 is formed at a position adjacent to the peripheral portion 132 of the liquid supply port 131 in the X direction. In the present embodiment, each of the fitting recessed portions 161 is formed as a recessed portion cut in the −Z direction. When the first liquid container 100*a* is disposed in the first case 61*a*, a portion of the tip end side wall portion 203 of the first case 61*a* is inserted and fitted into each of the fitting recessed portions 161. As a result, the liquid supply port 131 is positioned with respect to the first case 61*a* in the X direction.

Please refer to FIG. 10. The coupling member 120 is provided with two guided portions 165. Each of the guided portions 165 is provided as a through-hole penetrating through the coupling member 120 in the Z direction. Each of the guided portions 165 is provided at a position close to both side end portions in the X direction of the coupling member 120. The guided portion 165 is located on the −Y direction side from the liquid supply port 131, the container-side electrical coupling portion 140, and the fitting structure receiving portion 155. The two guided portions 165 are provided so as to be disposed side by side in the X direction. The two guided portions 165 are formed symmetrically with the center of the coupling member 120 in the X direction interposed therebetween. The opening shape of the guided portion 165 in the third surface portion 123 is substantially circular. The end portion on the +Y direction side of the guided portion 165 has a chamfered shape. That is, a planar portion 165*p* having a planar surface facing in the −Y direction is formed at the end portion of the guided portion 165 on the +Y direction side.

When the first liquid container 100*a* is disposed in the first case 61*a*, each of the guided portions 165 is guided by a guide portion 208 described later provided in the first case 61*a*, and the first liquid container 100*a* is positioned with respect to the first case 61*a*. In a state where the first liquid container 100*a* is disposed in the first case 61*a*, the guide portion 208 is fitted into the guided portion 165, and the coupling member 120 is fixed to the first case 61*a*.

Please refer to FIGS. 6, 8, and 10. The handle 170 is a portion that can be gripped when the user carries the first liquid container 100*a*. In the present embodiment, the handle 170 is prepared by molding a resin member such as polypropylene. The handle 170 is provided with a grip portion 171, two coupling portions 172 and 173, and two base end portions 174 and 175. The grip portion 171 is a portion on which the user puts the hand. The grip portion 171 is configured as a columnar portion along the X direction. In the present embodiment, the width of the grip portion 171 in the X direction is substantially the same as the width of the coupling member 120 and the bag-like member 110*a* in the X direction. The first coupling portion 172 couples the end portion on the +X direction side of the grip portion 171 and the first base end portion 174. The second coupling portion 173 couples the end portion on the −X direction side of the grip portion 171 and the second base end portion 175. Each of the base end portions 174 and 175 has a substantially cylindrical shaft-like portion protruding so as to face each other along the X direction. The shaft-like portions of the base end portions 174 and 175 are coupled to fixed portions 176 provided in the coupling member 120, respectively. The fixed portion 176 is formed as a shaft hole extending in the X direction, and the shaft-like portion of each of the base end portions 174 and 175 is inserted into the shaft hole in the X direction. As a result, the handle 170 is rotatably fixed to the first member 127*f* of the coupling member 120. In the present embodiment, the two base end portions 174 and 175 are located between the two guided portions 165 in the X direction.

Please refer to FIGS. 6 to 8. The first case 61*a* is configured as a substantially rectangular parallelepiped box whose longitudinal direction is in the Y direction, and is almost entirely opened on the −Z direction side to receive the liquid container 100. The first case 61*a* is made of, for example, a resin member such as polypropylene. The first case 61*a* is provided with a bottom surface wall portion 200, two side wall portions 201 and 202, a tip end side wall portion 203, and a rear end side wall portion 205.

Please refer to FIG. 7. The bottom surface wall portion 200 is a substantially rectangular wall portion constituting the bottom surface portion of the first case 61*a*, and extends in the X and Y directions. In this specification, the term of "extending" means a configuration that is continuous in a certain direction without being divided. In the middle of the extension, unevenness, a bend portion, a hole portion, a slit, and a joining portion may be provided. As illustrated in FIG. 8, the first liquid container 100*a* is disposed on a bottom surface 200*s* of the bottom surface wall portion 200, which is a surface facing the −Z direction. When the first liquid container 100*a* is disposed in the first case 61*a*, the bottom surface 200*s* is almost covered by the first liquid container 100*a*.

As illustrated in FIGS. 6 and 7, the first side wall portion 201 is a substantially rectangular wall portion that intersects and is coupled to the long side of the bottom surface wall portion 200 on the −X direction side, and forms a side wall portion of the first case 61*a* on the −X direction side. As illustrated in FIGS. 6 and 8, the second side wall portion 202 is a substantially rectangular wall portion that intersects and is coupled to the long side of the bottom surface wall portion 200 on the +X direction side, and forms a side wall portion of the first case 61*a* on the −X direction side. As illustrated in FIG. 6, the first side wall portion 201 and the second side wall portion 202 interpose the coupling member 120 in the X direction. The height of the first side wall portion 201 and the second side wall portion 202 is slightly lower than the height of the coupling member 120 of the first liquid container 100*a*. The first side wall portion 201 and the second side wall portion 202 interpose the bag-like member 110*a* of the first liquid container 100*a* in the X direction, and define the disposition posture of the bag-like member 110*a* in the direction along the Y direction.

Please refer to FIGS. 6, 8, and 10. The tip end side wall portion 203 stands at the end portion on the +Y direction side of the bottom surface wall portion 200 in the −Z direction. The tip end side wall portion 203 has a gap at the center in the X direction, and in a state where the first liquid container 100*a* is disposed, as illustrated in FIG. 6, the liquid supply port 131 and the peripheral portion 132 thereof are disposed between the gaps. The peripheral portion 132 slightly protrudes in the +Y direction from the two tip end side wall portions 203. A portion of the tip end side wall portion 203 is inserted and fitted into each fitting recessed portion 161 illustrated in FIG. 10 formed on both sides of the liquid supply port 131 in the X direction, and closes each of the fitting recessed portions 161.

Please refer to FIG. 6. In a state where the first liquid container 100*a* is disposed in the first case 61*a*, the tip end side wall portion 203 has a lower side wall portion 203*d* that covers a portion of the coupling member 120 below the container-side electrical coupling portion 140 and the third receiving portion 150*t*. Please refer to FIG. 10. The lower side wall portion 203*d* is provided with a through-hole 203*h* at a position corresponding to the first receiving portion 150*f* and the second receiving portion 150*s* for receiving the insertion of each of the positioning portions 53*f* and 53*s*. The through-hole 203*h* overlaps with the corresponding receiving portions 150*f* and 150*s* in the Y direction in a state where the first liquid container 100*a* is disposed in the first case 61*a*. As described above, the first case 61*a* is configured such that the receiving portions 150*f*, 150*s*, and 150*t* of the first liquid container 100*a* are exposed to the outside when the first mounting body 105*a* is configured. As a result, the insertion of the corresponding positioning portions 53*f*, 53*s*, and 53*t* into the receiving portions 150*f*, 150*s*, and 150*t* is prevented from being hindered by the case 61.

Please refer to FIGS. 6 and 7. The rear end side wall portion 205 extends in the X direction and the Z direction at an end portion on the −Y direction side of the bottom surface wall portion 200, and is coupled to the bottom surface wall portion 200 and the two side wall portions 201 and 202.

Please refer to FIG. 10. Two substantially columnar guide portions 208 protruding in the −Z direction are provided on the bottom surface 200*s* of the first case 61*a*. As described above, each of the two guide portions 208 fits into a corresponding one of the two guided portions 165 of the coupling member 120 of the first liquid container 100*a*. As a result, the first liquid container 100*a* is positioned on the first case 61*a*, and the displacement of the disposition position on the bottom surface 200*s* of the first liquid container 100*a* is suppressed.

Each guide portion 208 is shaped like a chamfered end portion on the +Y direction side, and has a planar portion 208*p* on the side surface facing in the +Y direction. When the guide portion 208 is fitted into the guided portion 165, the planar portion 208*p* of the guide portion 208 comes into surface contact with the planar portion 165*p* of the guided portion 165. As a result, the displacement of the disposition position of the first liquid container 100*a* with respect to the first case 61*a* due to the guide portion 208 and the guided portion 165 is further suppressed.

A projection portion 210 protruding in the −Z direction is provided at an end portion on the +Y direction side on the bottom surface 200*s* of the bottom surface wall portion 200. The projection portion 210 is located at a position closer to the −X direction side from the center portion in the X direction, and is located closer to the −X direction side from the fitting recessed portion 207 into which the peripheral portion 132 of the liquid supply port 131 is fitted. In the present embodiment, the projection portion 210 has a rectangular shape. The projection portion 210 is formed in a hollow. The internal space 211 formed on the rear side of the projection portion 210 will be described later.

As described above, when the first liquid container 100*a* is disposed in the first case 61*a*, the projection portion 210 is contained in the recessed portion 160 of the coupling member 120. In the present embodiment, when the projection portion 210 is contained in the recessed portion 160, the outer wall surface of the projection portion 210 and the inner wall surface of the recessed portion 160 come into surface contact with each other, and the projection portion 210 fits into the recessed portion 160. As a result, the projection portion 210 and the recessed portion 160 function as a positioning portion of the coupling member 120 in the first case 61*a*.

As described above, in the present embodiment, at least a portion of the container-side electrical coupling portion 140 is disposed above the recessed portion 160, and at least a portion of the container-side electrical coupling portion 140 is disposed above the projection portion 210 in the first mounting body 105*a*. Therefore, even when the liquid is leaked to the bottom surface 200*s* of the first case 61*a*, the projection portion 210 prevents the liquid from traveling along the wall surface of the first case 61*a* and reaching the container-side electrical coupling portion 140.

Please refer to FIG. 7. A groove portion 215 is provided at the end portion on the +Y direction side on the surface on the +Z direction side of the bottom surface wall portion 200. In the present embodiment, the groove portion 215 is formed by being surrounded by a rib 216. The groove portion 215 constitutes the case-side fixing structure 220 that regulates the movement of the first case 61*a* in the Y direction in cooperation with the apparatus-side fixing structure 54 illustrated in FIG. 5. In the present embodiment, the case-side fixing structure 220 is configured as a so-called heart cam. The end portion of the groove portion 215 on the +Y direction side is configured to include an internal space 211 of the above-described projection portion 210. That is, the internal space 211 of the projection portion 210 forms a portion of the case-side fixing structure 220 and is included in the case-side fixing structure 220. The internal space 211 of the projection portion 210 is open in the +Y direction, and forms an entrance of the case-side fixing structure 220.

When the first case 61*a* is inserted toward the predetermined disposition region LA illustrated in FIG. 3A, the case-side fixing structure 220 receives the entry of the protrusion portion 54*p*, which is the engaging portion of the apparatus-side fixing structure 54. When the first case 61*a* is pushed into the predetermined disposition region LA illustrated in FIG. 3A, the protrusion portion 54*p* moves along the groove of the case-side fixing structure 220 to a predetermined engaged portion. The movement of the first case 61*a* in the −Y direction is regulated by the engagement of the protrusion portion 54*p* with the engaged portion. In addition, when the first case 61*a* is further pushed in the +Y direction in a state where the protrusion portion 54*p* is locked to the case-side fixing structure 220, the protrusion portion 54*p* is separated from the engaged portion, and the engagement of the protrusion portion 54*p* with the case-side fixing structure 220 is released. As a result, the first case 61*a* receives the elastic force of the biasing member 57*e* of the coupling receiving portion 50 through the base end member 57, and is pushed out on the −Y direction side.

A plurality of rail ribs 230 and a plurality of leg portions 231 are further provided on the surface of the bottom surface wall portion 200 on the +Z direction side. The rail rib 230 is configured as a projection wall portion protruding in the +Z direction, and extends linearly with a substantially constant width in the Y direction. As described above, the rail rib 230 fits into the rail groove 64 provided on a floor surface of the case accommodation portion 60, and guides the movement of the first case 61*a* in the Y direction. The plurality of leg portions 231 protrude in the +Z direction, and have the same height as each other.

1-3. Configuration of Second Liquid Container and Second Case

Figure 12:
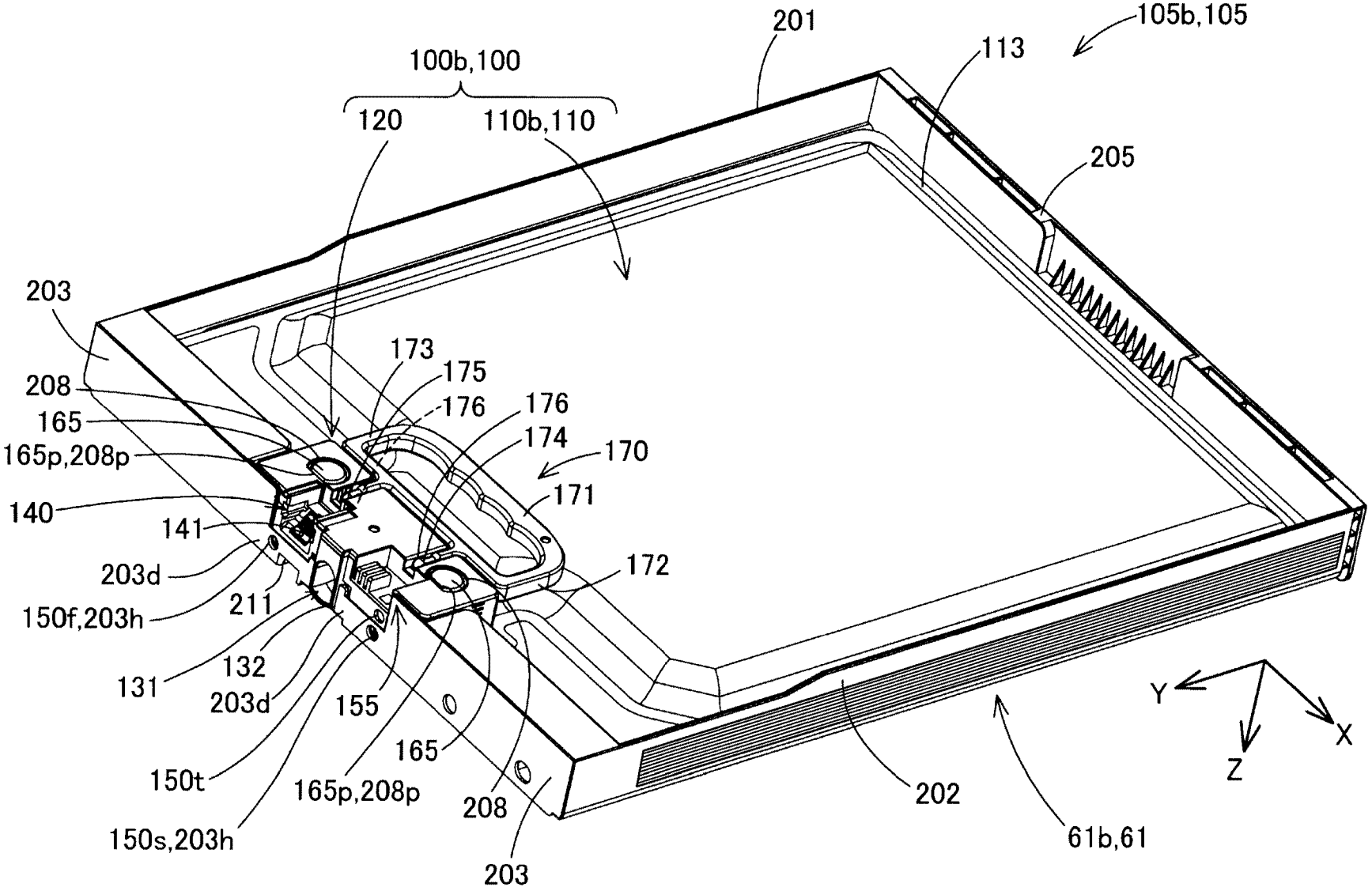
FIG. 12 is a schematic perspective view illustrating a front surface of a second mounting body.
Figure 13:
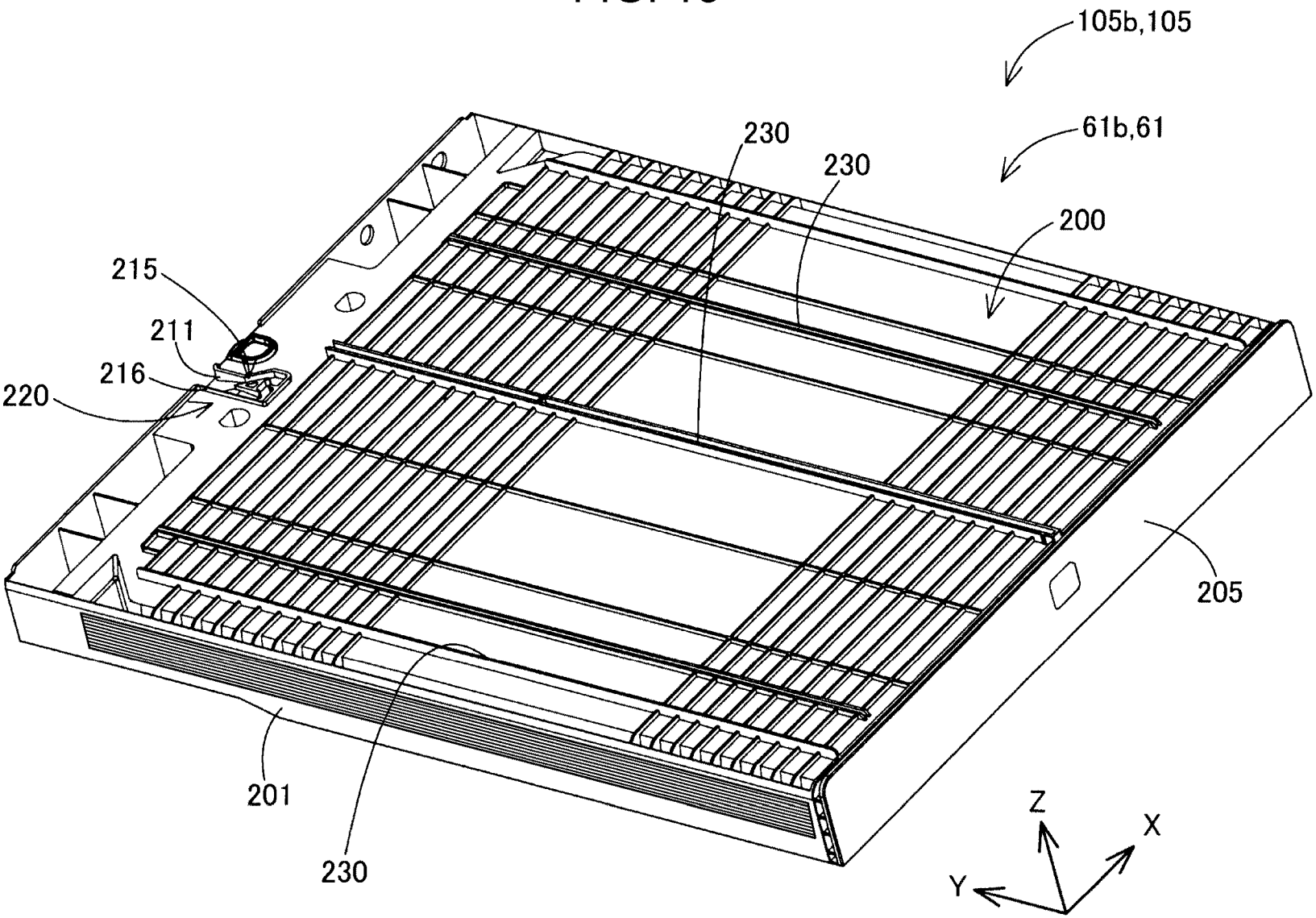
FIG. 13 is a schematic perspective view illustrating a rear surface of the second mounting body.
Figure 14:
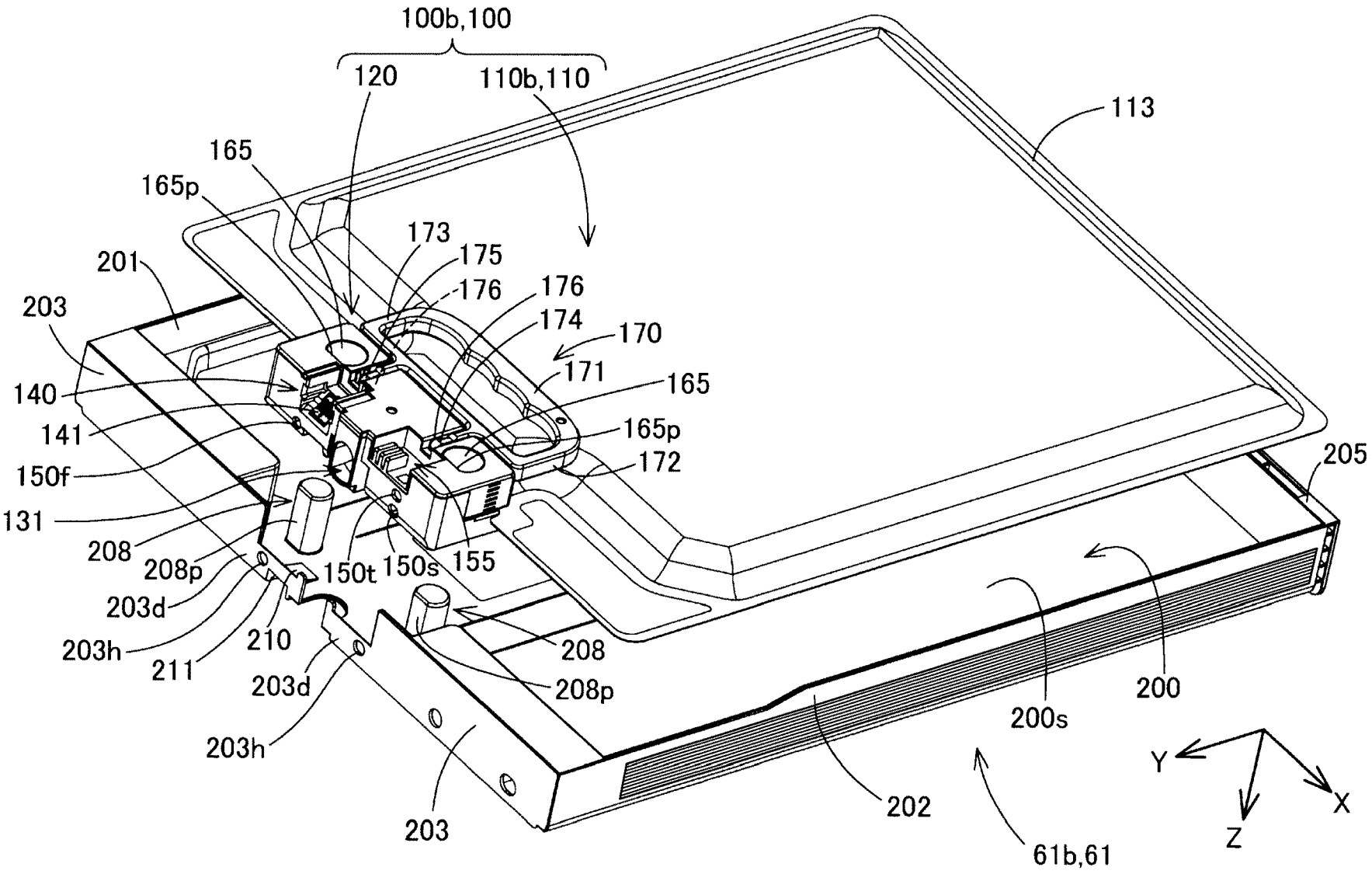
FIG. 14 is a schematic exploded perspective view of the second mounting body.

With reference to FIGS. 12 to 14, a configuration of a second liquid container 100*b* and a second case 61*b* that form a second mounting body 105*b* will be described. FIG. 12 is a schematic perspective view illustrating the front surface of the second mounting body 105*b*. FIG. 13 is a schematic perspective view illustrating the rear surface of the second mounting body 105*b*. FIG. 14 is a schematic exploded perspective view of a state where the second liquid container 100*b* is taken out from the second case 61*b* when viewed from the −Z direction side.

The second liquid container 100*b* is substantially the same except that the dimension of a bag-like member 110*b* in the X direction is larger than the dimension of the bag-like member 110*a* of the first liquid container 100*a* in the X direction. The configuration of the bag-like member 110*b* of the second liquid container 100*b* is substantially the same as the configuration of the bag-like member 110*b* of the first liquid container 100*a* except that the dimensions are different from each other. In this specification, the bag-like member 110*a* of the first liquid container 100*a* and the bag-like member 110*b* of the second liquid container 100*b* may be simply referred to as the bag-like member 110, unless it is particularly necessary to distinguish these. The second liquid container 100*b* is provided with a coupling member 120 common to the first liquid container 100*a*. The coupling member 120 is attached to the substantially central portion in the X direction at the end portion on the +Y direction side of the bag-like member 110*b*. The configuration of the second case 61*b* is substantially the same as that of the first case 61*a* except that the dimension in the X direction is enlarged so that the bag-like member 110*b* of the second liquid container 100*b* can be contained. In the second mounting body 105*b*, the second liquid container 100*b* is fixed by fitting the coupling member 120 into a recessed portion provided at the central portion in the X direction of the tip end side wall portion 203 of the second case 61*b*.

1-4. Mounting Mechanism of Liquid Container

Please refer to FIGS. 5, 6, 10, and 12. When the mounting body 105 is mounted on the liquid ejecting apparatus 10, the mounting body 105 is moved in the +Y direction toward the coupling receiving portion 50 in the case accommodation portion 60. At this time, the first positioning portion 53*f* and the second positioning portion 53*s* of the coupling receiving portion 50 are inserted into the first receiving portion 150*f* and the second receiving portion 150*s* of the liquid container 100, and the liquid supply port 131 of the liquid container 100 is positioned with respect to the liquid introduction portion 51 of the coupling receiving portion 50. Thereafter, the liquid introduction portion 51 of the coupling receiving portion 50 is inserted into the liquid supply port 131 of the liquid container 100, and the liquid supply port 131 of the liquid container 100 and the liquid introduction portion 51 of the coupling receiving portion 50 are coupled to each other. In addition, in parallel with the coupling between the liquid supply port 131 and the liquid introduction portion 51, the apparatus-side electrical coupling portion 52 of the coupling receiving portion 50 and the container-side electrical coupling portion 140 of the liquid container 100 are coupled to each other.

Before the coupling between the liquid supply port 131 and the liquid introduction portion 51 is completely completed, the peripheral portion 132 provided around the liquid supply port 131 contacts the base end member 57 around the liquid introduction portion 51. When the liquid container 100 and the case 61 are pushed in the +Y direction until the coupling between the liquid supply port 131 and the liquid introduction portion 51 is completed, the base end member 57 is displaced in the +Y direction. The liquid container 100 is biased in the −Y direction by a biasing member 57*e* provided inside the base end member 57. In addition, when the protrusion portion 54*p* of the apparatus-side fixing structure 54 of the coupling receiving portion 50 is inserted into the case-side fixing structure 220 from the recessed portion 160 of the case 61, and the coupling between the liquid supply port 131 and the liquid introduction portion 51 is completed, the protrusion portion 54*p* engages with the case-side fixing structure 220 is performed by the engagement mechanism described above.

Here, after the liquid introduction portion 51 is inserted into the liquid supply port 131 and before the apparatus-side electrical coupling portion 52 of the coupling receiving portion 50 and the container-side electrical coupling portion 140 are coupled to each other, the third positioning portion 53*t* of the coupling receiving portion 50 is inserted into the third receiving portion 150*t* of the liquid container 100. As a result, the occurrence of a positional displacement in which the liquid container 100 rotates about the central axis of the liquid supply port 131 is suppressed. Therefore, the occurrence of poor contact between the container-side electrical coupling portion 140 and the apparatus-side electrical coupling portion 52 due to such positional displacement is suppressed.

1-5. Summary of First Embodiment

As described above, according to the liquid container 100 according to the first embodiment, the first receiving portion 150*f* and the second receiving portion 150*s* are caused to receive the first positioning portion 53*f* and the second positioning portion 53*s*, so that the liquid supply port 131 can be positioned with respect to the liquid introduction portion 51. In addition, the third receiving portion 150*t* is caused to receive the third positioning portion 53*t*, so that the container-side electrical coupling portion 140 and the apparatus-side electrical coupling portion 52 can be electrically coupled in a state where the positional displacement of the liquid container 100 rotating about the central axis of the liquid supply port 131 is suppressed. Furthermore, when the rotation occurs about the central axis of the liquid supply port 131, the loads on each of the positioning portions 53*f*, 53*s*, and 53*t* are dispersed, so that the deformation and breakage of each of the positioning portions 53*f*, 53*s*, and 53*t* can be suppressed.

In addition, in the liquid container 100 according to the first embodiment, each of the positioning portions 53*f*, 53*s*, and 53*t* corresponding to each of the receiving portions 150*f*, 150*s*, and 150*t* is configured to fit in a play state with a gap. As a result, since each of the positioning portions 53*f*, 53*s*, and 53*t* can be easily inserted into each of the receiving portions 150*f*, 150*s*, and 150*t*, the mounting operation of the liquid container 100 on the liquid ejecting apparatus 10 is facilitated. In addition, according to the liquid container 100 according to the first embodiment, the posture of the liquid container 100 when mounted on the liquid ejecting apparatus 10 can be defined at three points where the three receiving portions 150*f*, 150*s*, and 150*t* are provided. Therefore, as described above, even when the positioning portions 53*f*, 53*s*, and 53*t* are configured to fit with each of the receiving portions 150*f*, 150*s*, and 150*t* in a play state, the posture of the liquid container 100 can be defined with higher accuracy than in a case in which the posture when mounting the liquid container 100 is defined by two points or less.

In the liquid container 100 according to the first embodiment, the second receiving portion 150*s* and the third receiving portion 150*t* are disposed side by side in the Z direction. As a result, when the second positioning portion 53*s* is inserted into the second receiving portion 150*s*, the third positioning portion 53*t* can be easily inserted into the third receiving portion 150*t*. Therefore, the mounting of the liquid container 100 on the liquid ejecting apparatus 10 is facilitated as compared with when the second receiving portion 150*s* and the third receiving portion 150*t* are not disposed side by side in the Z direction.

In the liquid container 100 according to the first embodiment, since the first receiving portion 150*f* and the second receiving portion 150*s* are disposed side by side in the X direction, when the liquid container 100 is mounted on the liquid ejecting apparatus 10, the disposition posture of the liquid container 100 in the X direction is appropriately determined. Therefore, the liquid container 100 is suppressed from being in a posture rotated about the central axis of the liquid supply port 131 as compared when the first receiving portion 150*f* and the second receiving portion 150*s* are not disposed side by side in the X direction.

In the liquid container 100 according to the first embodiment, the third receiving portion 150*t* and the container-side electrical coupling portion 140 are disposed side by side in the X direction. Therefore, the positional displacement of the container-side electrical coupling portion 140 in the rotation direction about the central axis of the liquid supply port 131 is suppressed, as compared when the third receiving portion 150*t* and the container-side electrical coupling portion 140 are not disposed side by side in the X direction.

In the liquid container 100 according to the first embodiment, the center of the first receiving portion 150*f* and the center of the second receiving portion 150*s* are located on the +Z direction side with respect to the center of the liquid supply port 131. In addition, the center of the third receiving portion 150*t* and the container-side electrical coupling portion 140 are located on the −Z direction side with respect to the center of the liquid supply port 131. As a result, the mounting posture of the liquid container 100 can be defined at three points surrounding the central axis of the liquid supply port 131, and the occurrence of positional displacement of the container-side electrical coupling portion 140 in the rotation direction about the central axis of the liquid supply port 131 can be more effectively suppressed.

In the liquid container 100 according to the first embodiment, the opening width of the second receiving portion 150*s* in the X direction is larger than the opening width of the first receiving portion 150*f* in the X direction. With this configuration, it is possible to allow a margin to the angle of the second positioning portion 53*s* to the Y direction in the horizontal direction when the second positioning portion 53*s* is inserted into the second receiving portion 150*s*. Therefore, the operation of coupling the liquid container 100 to the coupling receiving portion 50 is facilitated. In addition, when the liquid container 100 is coupled to the coupling receiving portion 50, the stress generated when the second positioning portion 53*s* is inserted into the second receiving portion 150*s* is reduced by providing such a margin. In the present embodiment, the opening widths of the first receiving portion 150*f* and the second receiving portion 150*s* in the Z direction are substantially equal to each other, and in other embodiments, the opening widths of the first receiving portion 150*f* and the second receiving portion 150*s* in the Z direction may be different from each other.

As illustrated in FIGS. 8, 10, and 14, in the liquid container 100, the recessed portion 160 in which the case-side fixing structure 220 is disposed is provided so as to be aligned in the +Z direction of the container-side electrical coupling portion 140. That is, in the mounting body 105, when the liquid container 100 is viewed in plan view in the −Y direction, the container-side electrical coupling portion 140 and the case-side fixing structure 220 are disposed in the Z direction. As a result, when the protrusion portion 54*p* of the apparatus-side fixing structure 54 is at a position where the protrusion portion 54*p* is locked to the case-side fixing structure 220, the positional displacement of the container-side electrical coupling portion 140 in the X direction with respect to the apparatus-side electrical coupling portion 52 is suppressed. Therefore, when the protrusion portion 54*p* of the apparatus-side fixing structure 54 is locked to the case-side fixing structure 220, a good electrical coupling state of the liquid container 100 to the liquid ejecting apparatus 10 can be established.

2. Second Embodiment

Figure 16:
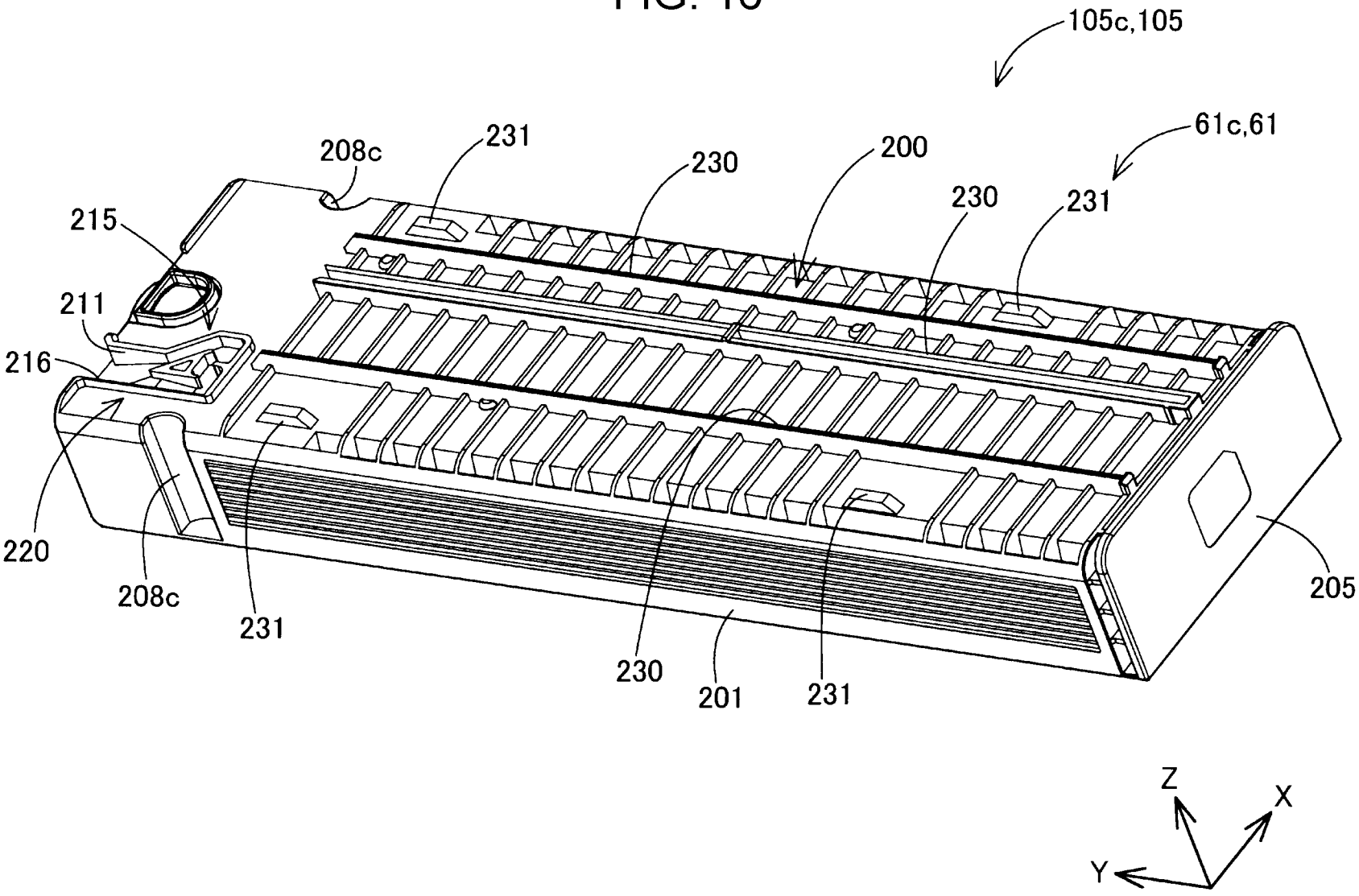
FIG. 16 is a schematic perspective view illustrating a rear surface of the mounting body according to the second embodiment.
Figure 17:
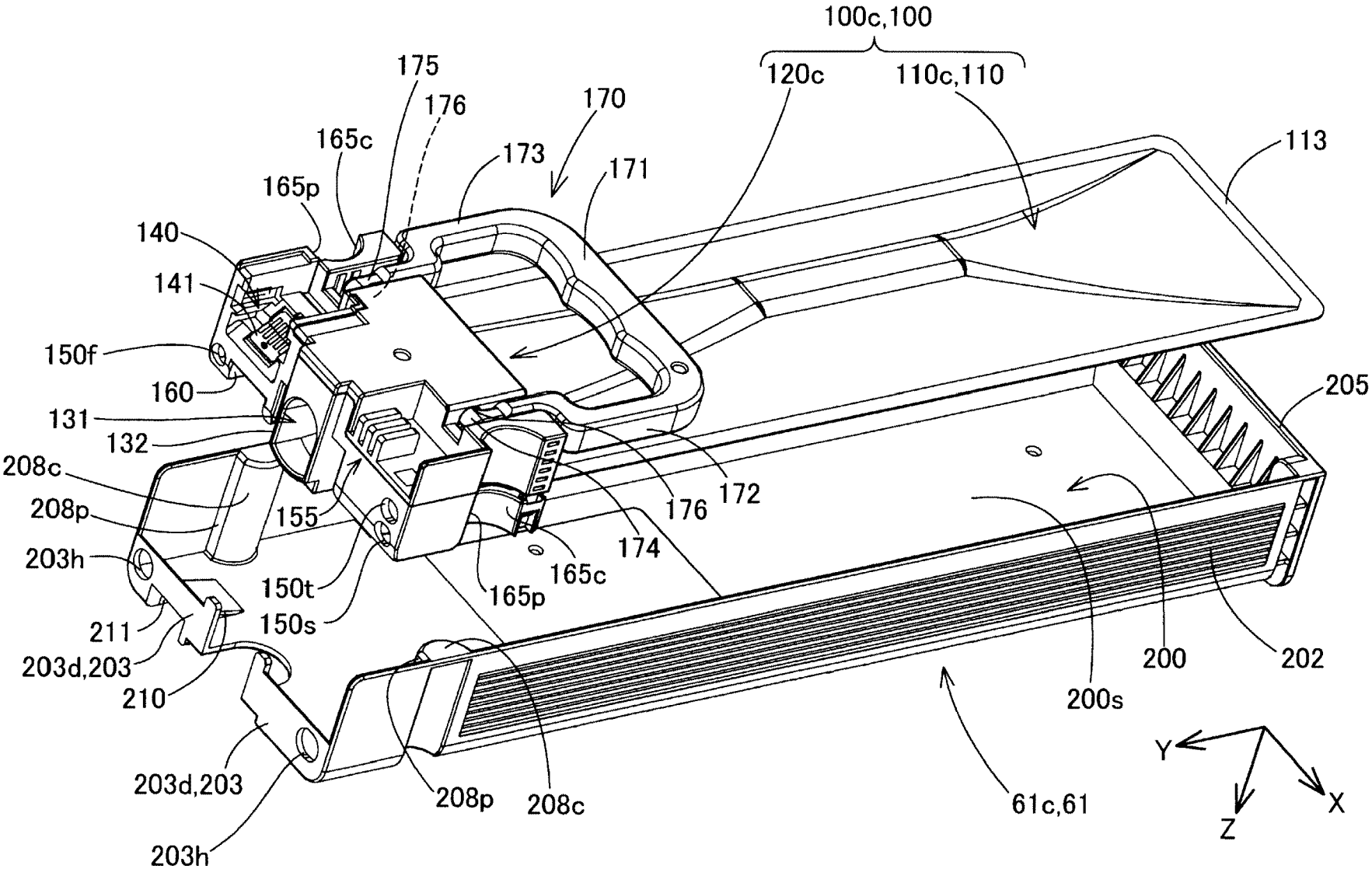
FIG. 17 is a schematic exploded perspective view of the mounting body according to the second embodiment.

A configurations of a liquid container 100*c* and a case 61*c* according to a second embodiment will be described with reference to FIGS. 15 to 17. FIG. 15 is a schematic perspective view illustrating the front surface of the mounting body 105*c* constituted to include the liquid container 100*c* and the case 61*c*. FIG. 16 is a schematic perspective view illustrating the rear surface of the mounting body 105*c*. FIG. 17 is a schematic exploded perspective view of the state where the liquid container 100*c* is taken out from the case 61*c* when viewed on the −Z direction side.

The liquid container 100*c* according to the second embodiment is disposed in the case 61*c* according to the second embodiment, and forms a mounting body 105*c* according to the second embodiment. The mounting body 105*c* according to the second embodiment can be mounted on the liquid ejecting apparatus 10 described in the first embodiment instead of any of the first mounting bodies 105*a*. That is, in the second embodiment, three mounting bodies 105*a* to 105*c* can be mounted on the liquid ejecting apparatus 10. Hereinafter, the liquid container 100*c* is referred to as a "third liquid container 100*c*", the case 61*c* is referred to as a "third case 61*c*", and the mounting body 105*c* is referred to as a "third mounting body 105*c*". Similarly to the first embodiment, when there is no particular need to distinguish these, each of the liquid containers 100*a* to 100*c*, each of the cases 61*a* to 61*c*, and each of the mounting bodies 105*a* to 105*c* are collectively referred to as the liquid container 100, the case 61, and the mounting body 105, respectively.

The configurations of the third liquid container 100*c* and the third case 61*c* are substantially the same as the configurations of the first liquid container 100*a* and the first case 61*a*, respectively, except for the points described below. A coupling member 120*c* of the third liquid container 100*c* corresponds to a configuration in which both end portions in the X direction of the coupling member 120 of the first liquid container 100*a* are cut out to reduce the dimension in the X direction. Therefore, in the coupling member 120*c*, two guided portions 165*c* are configured as semi-cylindrical recessed portions provided on both side surfaces in the X direction. A planar portion 165*p* is formed at end portions of the two guided portions 165*c* on the +Y direction side. Other configurations of the coupling member 120*c* are substantially the same as that of the coupling member 120 described in the first embodiment. The coupling member 120*c* can be coupled to the coupling receiving portion 50 of FIG. 5 described in the first embodiment, similarly to the coupling member 120 of the first liquid container 100*a* and the second liquid container 100*b*.

In addition, in the third liquid container 100*c*, the dimension of the bag-like member 110*c* in the X direction is substantially the same as the dimension of the coupling member 120*c* in the X direction, and is smaller than the dimension of the bag-like member 110*a* of the first liquid container 100*a* in the X direction. The dimension of the bag-like member 110*c* of the third liquid container 100*c* in the Y direction is shorter than the dimension of the bag-like member 110*a* of the first liquid container 100*a* in the Y direction. In addition, in the third liquid container 100*c*, the dimension of the grip portion 171 of the handle 170 in the X direction is configured to be smaller in accordance with the dimension of the coupling member 120*c* in the X direction.

In the third case 61*c*, the distance between a first side wall portion 201 and a second side wall portion 202 in the X direction is reduced in accordance with the dimension of the third liquid container 100*c* in the X direction. In the third case 61*c*, the two guide portions 208*c* are formed as semi-cylindrical projection portions provided on the first side wall portion 201 and the second side wall portion 202. Each of the guide portions 208*c* includes a planar portion 208*p* which is in surface contact with the planar portion 165*p* of the corresponding guided portion 165*c*, at the end portion on the +Y direction side. In addition, in the third case 61*c*, the distance in the Y direction between the tip end side wall portion 203 and the rear end side wall portion 205 is reduced in accordance with the dimension of the third liquid container 100*c* in the Y direction.

The third liquid container 100*c* includes three receiving portions 150*f*, 150*s*, and 150*t* corresponding to the three positioning portions 53*f*, 53*s*, and 53*t* of the coupling receiving portion 50, similarly to the first liquid container 100*a* and the second liquid container 100*b*. Therefore, with the third liquid container 100*c*, the mounting posture on the liquid ejecting apparatus 10 is improved similarly to the first liquid container 100*a* and the second liquid container 100*b*. In addition, according to the third liquid container 100*c* and the third mounting body 105*c* according to the second embodiment, and the liquid ejecting apparatus 10 on which these are mounted, various functions and effects similar to those described in the first embodiment can be obtained.

3. Third Embodiment

Figure 18:
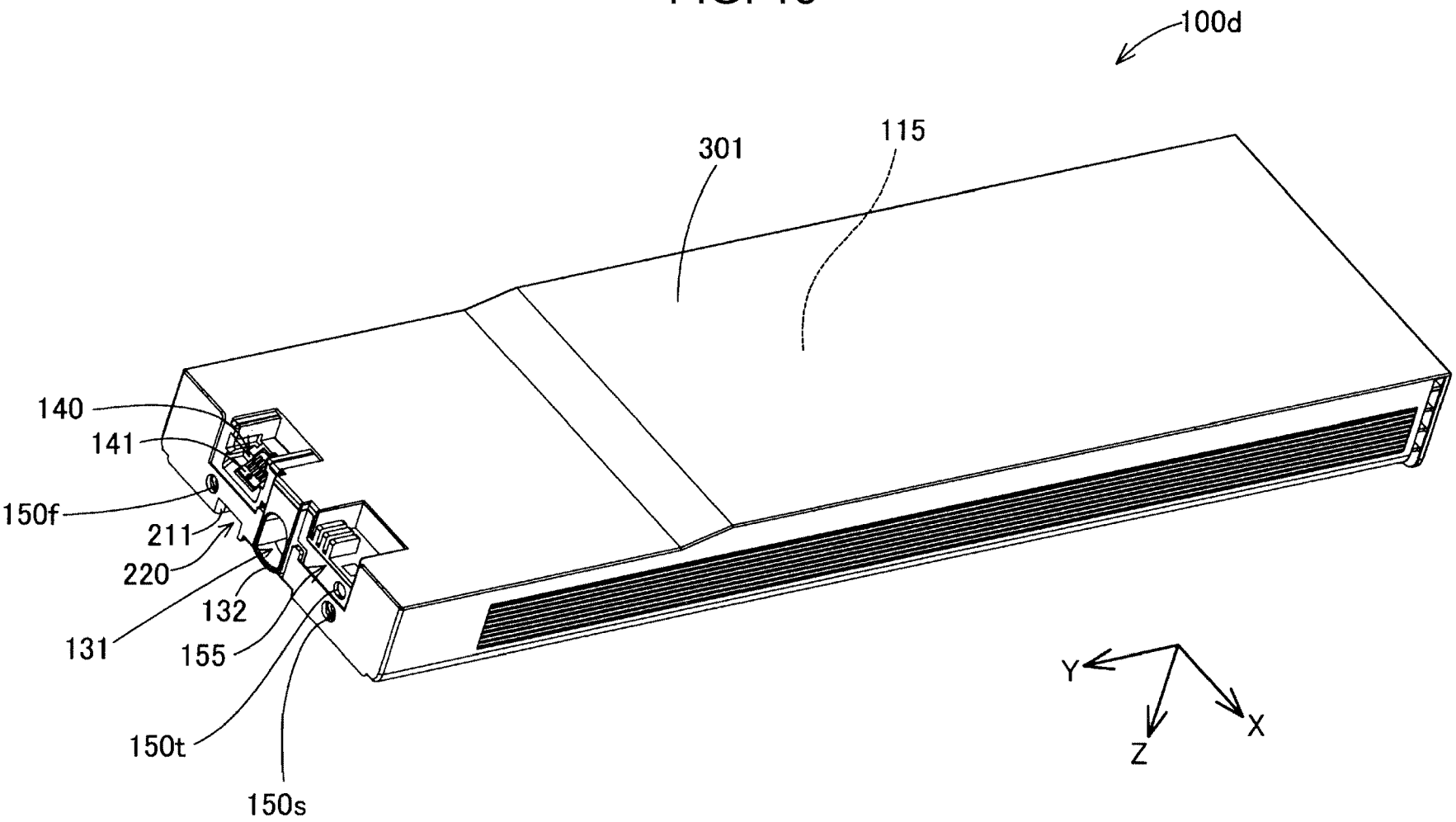
FIG. 18 is a schematic perspective view illustrating a configuration of a liquid container according to a third embodiment.

FIG. 18 is a schematic perspective view illustrating a configuration of a liquid container 100*d* according to a third embodiment. The liquid container 100*d* according to the third embodiment is configured as a so-called ink cartridge. The liquid container 100*d* according to the third embodiment can be mounted on the liquid ejecting apparatus 10 described in the first embodiment. The liquid container 100*d* according to the third embodiment is provided with a casing 301 having a substantially rectangular parallelepiped shape in which the Y direction is the longitudinal direction and the dimension in the Z direction is smaller than the dimensions in the X direction and the Y direction. The dimensions such as the length, width, and height of the casing 301 are the same as those of the first case 61*a* described in the first embodiment. The casing 301 may be configured to have the same dimensions as the second case 61*b* described in the first embodiment and the third case 61*c* described in the second embodiment. The liquid containing portion 115 in which ink consumed in the liquid ejecting apparatus 10 is contained is provided inside the casing 301. The liquid containing portion 115 may not be configured as an internal space of the bag-like member 110*a*.

The tip end portion of the casing 301 on the +Y direction side is configured similarly to the coupling member 120 described in the first embodiment. The liquid supply port 131, the container-side electrical coupling portion 140, the fitting structure receiving portion 155, the case-side fixing structure 220, and three receiving portions 150*f*, 150*s*, and 150*t* are provided at the tip end portion of the casing 301 on the +Y direction side. The liquid container 100*d* is inserted into the case accommodation portion 60 of the liquid ejecting apparatus 10 from the tip end portion on the +Y direction side. The liquid container 100*d* is coupled to the coupling receiving portion 50 in the case accommodation portion 60 by moving in the +Y direction, similarly to the first mounting body 105*a* described in the first embodiment.

According to the liquid container 100*d* according to the third embodiment, since the three receiving portions 150*f*, 150*s*, and 150*t* are provided at the tip end portion on the +Y direction side, the mounting posture of the liquid ejecting apparatus 10 is improved, similarly to the first mounting body 105*a* described in the first embodiment. In addition, according to the liquid container 100*d* and the liquid ejecting apparatus 10 according to the third embodiment, various functions and effects similar to those described in the first embodiment can be obtained.

4. Fourth Embodiment

Figure 19:
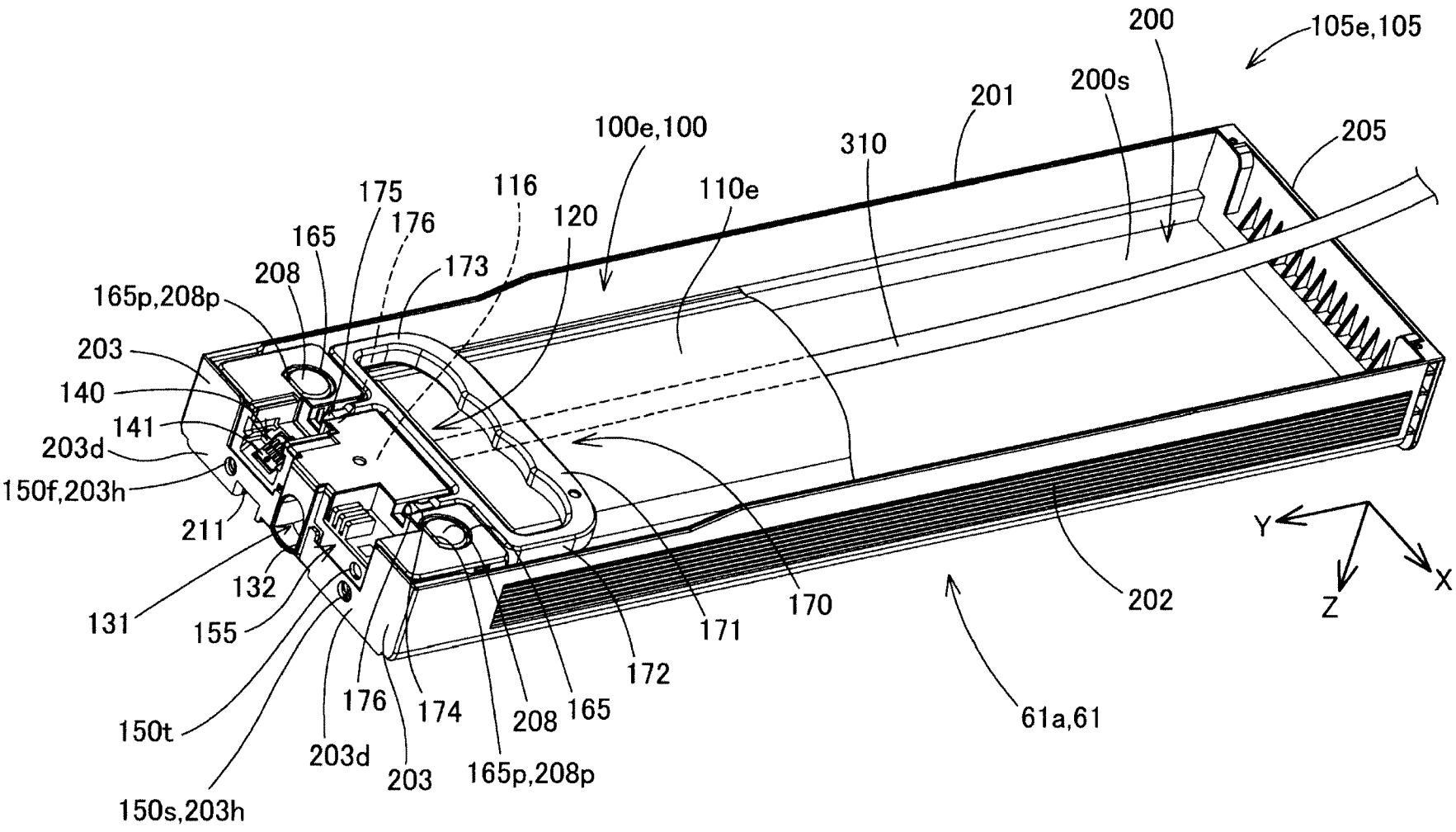
FIG. 19 is a schematic perspective view illustrating a configuration of a liquid container and a mounting body according to a fourth embodiment.

FIG. 19 is a schematic perspective view illustrating a configuration of a liquid container 100*e* and a mounting body 105*e* according to a fourth embodiment. The configuration of the liquid container 100*e* according to the fourth embodiment is substantially the same as the configuration of the first liquid container 100*a* according to the first embodiment, except for the points described below. The liquid container 100*e* includes a bag-like member 110*e* in which an end portion on the −Y direction side opens, instead of the bag-like member 110*a*. In addition, the tube 310 is inserted from the end portion of the bag-like member 110*e* on the −Y direction side and coupled to the supply port member 116 provided inside the coupling member 120. The tube 310 is coupled to a tank (not illustrated) that accommodates the liquid. In the liquid container 100*e*, the tube 310 corresponds to a liquid containing portion.

The liquid container 100*e* is disposed in the same first case 61*a* as described in the first embodiment, and forms the mounting body 105*e* according to the fourth embodiment. The mounting body 105*e* is mounted on the liquid ejecting apparatus 10 described in the first embodiment instead of the first mounting body 105*a* described in the first embodiment. The liquid ejecting apparatus 10 receives supply of liquid from an external tank through the tube 310 included in the liquid container 100*e* of the mounting body 105*e*. As a result, the supply of the liquid to the liquid ejecting apparatus 10 can be continued from the external tank without replacing the mounting body 105*e*.

According to the liquid container 100*e* according to the fourth embodiment, since the three receiving portions 150*f*, 150*s*, and 150*t* are provided, the mounting posture in the liquid ejecting apparatus 10 is improved, similarly to the first liquid container 100*a* described in the first embodiment. In addition, according to the liquid container 100*e*, the mounting body 105*e*, and the liquid ejecting apparatus 10 to which these are mounted according to the fourth embodiment, various functions and effects similar to those described in the above embodiments can be obtained. The configuration in which the tube 310 is coupled to the second liquid container 100*b*, the second mounting body 105*b*, the third liquid container 100*c*, and the third mounting body 105*c* described in each of the above embodiments can be applied.

5. Other Embodiments

The various configurations described in the above embodiments can be modified as follows, for example. Any of the configurations of the other embodiments described below are positioned as an example of an embodiment for performing the technique of the present disclosure.

Other Embodiment 1

In each of the above embodiments, the dimensions of the bag-like members 110*a*, 110*b*, and 110*c* may be appropriately modified. For example, in the first mounting body 105*a*, the dimension of the bag-like member 110*a* in the Y direction may be reduced to approximately 50 to 80% of the dimension of the first case 61*a* in the Y direction. In addition, in the second mounting body 105*b* and the third mounting body 105*c*, the dimension of each of the bag-like members 110*b* and 110*c* in the Y direction may be similarly reduced.

Other Embodiment 2

A mounting body in which the third liquid container 100*c* is disposed in the first case 61*a* may be mounted on the liquid ejecting apparatus 10. In addition, the liquid ejecting apparatus 10 may be equipped with a mounting body in which the first liquid container 100*a* or the third liquid container 100*c* is disposed in the second case 61*b*.

Other Embodiment 3

The positions where the receiving portions 150*f*, 150*s*, and 150*t* are provided in the liquid container 100 and the positions where the positioning portions 53*f*, 53*s*, and 53*t* are provided in the liquid ejecting apparatus 10 are not limited to the positions described in the above-described embodiments. For example, the disposition positions of the positioning portions 53*f*, 53*s*, and 53*t* may be switched between the +X direction side and the −X direction side. The third receiving portion 150*t* may be provided on the same side as the container-side electrical coupling portion 140 with the liquid supply port 131 interposed therebetween in the X direction. In addition, the first receiving portion 150*f* and the second receiving portion 150*s* may not be disposed side by side in the X direction, and the second receiving portion 150*s* and the third receiving portion 150*t* may not be disposed side by side in the Z direction. The first receiving portion 150*f* and the second receiving portion 150*s* may be provided at positions aligned with the liquid supply port 131 in the X direction, or the third receiving portion 150*t* may be provided on the +Z direction side of the second receiving portion 150*s*. In such a configuration, the positions of the positioning portions 53*f*, 53*s*, and 53*t* in the liquid ejecting apparatus 10 may be determined in accordance with the positions of the receiving portions 150*f*, 150*s*, and 150*t*.

Other Embodiment 4

In each of the above embodiments, the tip end side wall portion 203 of the case 61 may be configured to include a through-hole that overlaps the third receiving portion 150*t* in the Y direction. In addition, a portion where the through-hole 203*h* is formed may be cut off in the tip end side wall portion 203.

Other Embodiment 5

In each of the above embodiments, the corresponding positioning portions 53*f*, 53*s*, and 53*t* may be configured to fit tightly into at least one of the receiving portions 150*f*, 150*s*, and 150*t*.

6. Aspect Example

The technique of the present disclosure is not limited to the above embodiments and examples, and can be implemented in various forms without departing from the spirit thereof. For example, the technique of the present disclosure can be realized as the following embodiments. The technical features in each of the above embodiments corresponding to the technical features in each of the embodiments described below can be replaced or combined as appropriate in order to solve a portion or all of the problems to be achieved by the technique of the present disclosure, or to achieve a portion or all of the effects to be achieved by the technique of the present disclosure. In addition, when the technical features are not described as essential in the present specification, the technical features can be deleted as appropriate.

1. A first aspect is provided as a liquid container be attachable to and detachable from a liquid ejecting apparatus. When three directions orthogonal to each other in the liquid container are defined as an X direction, a Y direction, and a Z direction, a moving direction of the liquid container when mounting the liquid container on the liquid ejecting apparatus is defined as a +Y direction and a moving direction of the liquid container when removing the liquid container from the liquid ejecting apparatus is defined as a −Y direction in the Y direction, and a positive direction is defined as a +X direction and a negative direction is defined as a −X direction in the X direction, the liquid container according to this aspect includes a liquid containing portion in which a liquid supplied to the liquid ejecting apparatus is contained, a liquid supply port that is disposed on the +Y direction side of the liquid containing portion, that is coupled to the liquid ejecting apparatus, and through which the liquid of the liquid containing portion flows out, a container-side electrical coupling portion that is disposed on the +Y direction side of the liquid containing portion and on the −X direction side of the liquid supply port, and that is electrically coupled to the liquid ejecting apparatus, a first receiving portion that is disposed on the +Y direction side of the liquid containing portion and on the −X direction side of the liquid supply port, that is provided at a position different from that of the container-side electrical coupling portion in the Z direction, and that is configured to receive insertion of a first positioning portion provided in the liquid ejecting apparatus in the −Y direction, a second receiving portion that is disposed on the +Y direction side of the liquid containing portion and on the +X direction side of the liquid supply port, and that is configured to receive insertion of a second positioning portion provided in the liquid ejecting apparatus in the −Y direction, and a third receiving portion that is disposed on the +Y direction side of the liquid containing portion and on the +X direction side of the liquid supply port, that is provided at a position different from that of the second receiving portion in the Z direction, and that is configured to receive insertion of a third positioning portion provided in the liquid ejecting apparatus in the −Y direction. In the liquid container of this aspect, the liquid supply port in the X direction can be positioned by causing the first receiving portion and the second receiving portion to receive the first positioning portion and the second positioning portion. In addition, by causing the third receiving portion to receive the third positioning portion, it is possible to suppress the occurrence of a positional displacement in which the liquid container rotates about the central axis of the liquid supply port. Therefore, the mounting posture of the liquid container with respect to the liquid ejecting apparatus is improved, a good electrical coupling state between the liquid ejecting apparatus and the container-side electrical coupling portion can be established, and the coupling state can be maintained.

2. In the liquid container according to the aspect described above, the third receiving portion may be disposed on the +X direction side of the liquid supply port, and that is provided at a position different from that of the second receiving portion in the Z direction.

In the liquid container of this aspect, the third receiving portion is disposed at a position separated from the container-side electrical coupling portion opposite to the container-side electrical coupling portion with the liquid supply port interposed therebetween in the X direction. Therefore, it is possible to more effectively suppress the positional displacement of the rotation of the liquid container about the central axis of the liquid supply port.

3. In the liquid container according to the aspect described above, the second receiving portion and the third receiving portion may be disposed side by side in the Z direction.

In the liquid container of this aspect, when the second positioning portion is inserted into the second receiving portion, the third positioning portion can be easily inserted into the third receiving portion. Accordingly, the mounting of the liquid container on the liquid ejecting apparatus is facilitated than when the second receiving portion and the third receiving portion are not disposed side by side in the Z direction.

4. In the liquid container according to the aspect described above, the first receiving portion and the second receiving portion may be disposed side by side in the X direction.

In the liquid container of this aspect, the disposition posture of the liquid container in the X direction can be appropriately determined by the first receiving portion and the second receiving portion. Therefore, the liquid container is prevented from being in a posture rotated about the central axis of the liquid supply port than when the first receiving portion and the second receiving portion are not disposed side by side in the X direction.

5. In the liquid container according to the aspect described above, the third receiving portion and the container-side electrical coupling portion may be disposed side by side in the X direction.

In the liquid container of this aspect, the positional displacement of the container-side electrical coupling portion in the rotation direction about the central axis of the liquid supply port is suppressed, than when the third receiving portion and the container-side electrical coupling portion are not disposed side by side in the X direction.

6. In the liquid container according to the aspect described above, when a positive direction is defined as a +Z direction and a negative direction is defined as a −Z direction in the Z direction, a center of the first receiving portion and a center of the second receiving portion may be located on the +Z direction side with respect to a center of the liquid supply port, and a center of the third receiving portion and the container-side electrical coupling portion may be located on the −Z direction side with respect to the center of the liquid supply port.

In the liquid container of this embodiment, the mounting posture of the liquid container can be defined at three points surrounding the central axis of the liquid supply port. Accordingly, it is possible to more effectively suppress occurrence of the positional displacement of the container-side electrical coupling portion in the rotation direction about the central axis of the liquid supply port.

7. A second aspect is provided as a mounting body. The mounting body according to this aspect includes a case accommodated in a liquid ejecting apparatus, and the liquid container according to the aspect, that is attachably and detachably disposed with respect to the case, and is mounted on the liquid ejecting apparatus in a state where the liquid container is disposed in the case, in which the case may be provided with a through-hole at a position overlapping the first receiving portion and the second receiving portion in the Y direction in the state where the liquid container is disposed in the case.

In the mounting body of this aspect, mounting of the liquid container on the liquid ejecting apparatus can be facilitated by using the case. In addition, since the case includes the through-holes, the insertion of the positioning portions into the receiving portions is prevented from being hindered by the case.

8. A third aspect is provided as a liquid ejecting apparatus. The liquid ejecting apparatus according to this aspect includes a case accommodation portion in which the mounting body according to the aspect is accommodated, in which a liquid introduction portion coupled to the liquid supply port, an apparatus-side electrical coupling portion with which the container-side electrical coupling portion is in electrical contact, the first positioning portion, the second positioning portion, and the third positioning portion may be provided in the case accommodation portion at positions facing an end portion of the liquid container on the +Y direction side.

In the liquid ejecting apparatus of this aspect, the mounting posture of the liquid container is improved, and the coupling to the liquid container is enhanced.

7. Others

The technique of the present disclosure can be realized in various aspects other than the liquid container, the mounting body, and the liquid ejecting apparatus. For example, the present disclosure can be realized in the aspect of a coupling member used for a liquid container, a method of mounting the liquid container on the liquid ejecting apparatus, a method of positioning the liquid container in the liquid ejecting apparatus, a coupling structure of the liquid container, a liquid consumption system, and the like.

In addition, the configuration of the liquid container according to the present disclosure can be applied to a liquid container used in any liquid ejecting apparatus that consumes liquid other than ink. For example, the present disclosure can be applied to liquid containers used in various liquid ejecting apparatuses as described below.

An image recording device such as a facsimile device.

A color material ejecting apparatus used for manufacturing a color filter for an image display device such as a liquid crystal display.

An electrode material ejecting apparatus used for forming electrodes such as an organic electro luminescence (EL) display and a field emission display (FED).

A liquid ejecting apparatus that ejects a liquid containing a biological organic substance used for manufacturing a biochip.

Sample ejecting device as a precision pipette.

Lubricating oil ejecting apparatus.

Resin liquid ejecting apparatus.

A liquid ejecting apparatus that ejects lubricating oil into precision equipment such as a timepiece and a camera.

A liquid ejecting apparatus that ejects a transparent resin liquid such as an ultraviolet curable resin liquid onto a substrate to form a micro hemispherical lens (optical lens) used for an optical communication element or the like.

A liquid ejecting apparatus that ejects an acidic or alkaline etching solution to etch a substrate or the like.

A liquid ejecting apparatus including a liquid consuming head for ejecting any other minute amount of droplets.

The liquid contained in the liquid container of the present disclosure may be a material in a state where a substance is in a liquid phase. Therefore, the "liquid" in the present disclosure also includes a material in a liquid state having high or low viscosity, sol, gel water, other inorganic solvent, organic solvent, solution, liquid resin, and a material in a liquid state such as liquid metal including metal melt. In addition, not only a liquid as one state of a material but also a material in which particles of a functional material formed of a solid such as a pigment or metal particles are dissolved, dispersed, or mixed in a solvent is included. In addition, typical examples of the liquid include ink and liquid crystal as described in the above embodiment. Here, the "ink"

includes various liquid compositions such as general water-based inks, oil-based inks, pigment inks, dye inks, gel inks, and hot melt inks.

What is claimed is:

1. A liquid container configured to be attachable to and detachable from a liquid ejecting apparatus, the liquid ejecting apparatus having a first positioning portion, a second positioning portion and a third positioning portion that are configured to engaging with the liquid container, the liquid container comprising:

when three directions orthogonal to each other in the liquid container are defined as an X direction, a Y direction, and a Z direction, a moving direction of the liquid container when mounting the liquid container on the liquid ejecting apparatus is defined as a +Y direction and a moving direction of the liquid container when removing the liquid container from the liquid ejecting apparatus is defined as a −Y direction in the Y direction, and a positive direction is defined as a +X direction and a negative direction is defined as a −X direction in the X direction, a liquid containing portion in which a liquid supplied to the liquid ejecting apparatus is contained;

a liquid supply port that is disposed on the +Y direction side of the liquid containing portion, that is coupled to the liquid ejecting apparatus, and through which the liquid of the liquid containing portion flows out;

a container-side electrical coupling portion that is disposed on the +Y direction side of the liquid containing portion and on the −X direction side of the liquid supply port, and that is electrically coupled to the liquid ejecting apparatus;

a first receiving portion that is disposed on the +Y direction side of the liquid containing portion and on the −X direction side of the liquid supply port, that is provided at a position different from that of the container-side electrical coupling portion in the Z direction, and that is configured to receive insertion of the first positioning portion of the liquid ejecting apparatus in the −Y direction;

a second receiving portion that is disposed on the +Y direction side of the liquid containing portion and on the +X direction side of the liquid supply port, and that is configured to receive insertion of the second positioning portion of the liquid ejecting apparatus in the −Y direction; and a third receiving portion that is disposed on the +Y direction side of the liquid containing portion, and that is configured to receive insertion of the third positioning portion of the liquid ejecting apparatus in the −Y direction.

2. The liquid container according to claim 1, wherein the third receiving portion is disposed on the +X direction side of the liquid supply port, and that is provided at a position different from that of the second receiving portion in the Z direction.

3. The liquid container according to claim 1, wherein the second receiving portion and the third receiving portion are disposed side by side in the Z direction.

4. The liquid container according to claim 1, wherein the first receiving portion and the second receiving portion are disposed side by side in the X direction.

5. The liquid container according to claim 1, wherein the third receiving portion and the container-side electrical coupling portion are disposed side by side in the X direction.

6. The liquid container according to claim 1, wherein when a positive direction is defined as a +Z direction and a negative direction is defined as a −Z direction in the Z direction, a center of the first receiving portion and a center of the second receiving portion are located on the +Z direction side with respect to a center of the liquid supply port, and a center of the third receiving portion and the container-side electrical coupling portion are located on the −Z direction side with respect to the center of the liquid supply port.

7. A mounting body comprising:

a case accommodated in a liquid ejecting apparatus; and the liquid container according to claim 1, that is attachably and detachably disposed with respect to the case, and is mounted on the liquid ejecting apparatus in a state where the liquid container is disposed in the case, wherein the case is provided with a through-hole at a position overlapping the first receiving portion and the second receiving portion in the Y direction in the state where the liquid container is disposed in the case.

8. A liquid ejecting apparatus comprising:

a case accommodation portion in which the mounting body according to claim 7 is accommodated, wherein a liquid introduction portion coupled to the liquid supply port, an apparatus-side electrical coupling portion with which the container-side electrical coupling portion is in electrical contact, the first positioning portion, the second positioning portion, and the third positioning portion are provided in the case accommodation portion at positions facing an end portion of the liquid container on the +Y direction side.

* * * * *